US008319717B2

(12) United States Patent
Kim et al.

(10) Patent No.: US 8,319,717 B2
(45) Date of Patent: Nov. 27, 2012

(54) LIQUID CRYSTAL DISPLAY AND DRIVING METHOD THEREOF

(75) Inventors: Jinsung Kim, Gumi-si (KR); Suhyuk Jang, Daegu (KR)

(73) Assignee: LG Display Co., Ltd., Seoul (KR)

( * ) Notice: Subject to any disclaimer, the term of this patent is extended or adjusted under 35 U.S.C. 154(b) by 904 days.

(21) Appl. No.: 12/314,694

(22) Filed: Dec. 15, 2008

(65) Prior Publication Data

US 2009/0310077 A1 Dec. 17, 2009

(30) Foreign Application Priority Data

Jun. 12, 2008 (KR) ..... 10-2008-0055419

(51) Int. Cl.
*G09G 3/36* (2006.01)

(52) U.S. Cl. ..... 345/96; 345/209; 345/690; 345/89; 345/99

(58) Field of Classification Search ..... 345/204, 345/208, 209, 210, 87–103, 690
See application file for complete search history.

(56) References Cited

U.S. PATENT DOCUMENTS

| | | | | |
|---|---|---|---|---|
| 6,680,722 | B1 * | 1/2004 | Hiraki et al. | 345/96 |
| 7,133,035 | B2 * | 11/2006 | Kim et al. | 345/204 |
| 7,319,450 | B2 * | 1/2008 | Choi | 345/92 |
| 7,382,343 | B2 * | 6/2008 | Hiraki et al. | 345/96 |
| 7,714,854 | B2 * | 5/2010 | Kim et al. | 345/204 |
| 7,932,884 | B2 * | 4/2011 | Song et al. | 345/96 |
| 7,965,286 | B2 * | 6/2011 | Ryu et al. | 345/209 |
| 2003/0034943 | A1 * | 2/2003 | Takeda | 345/87 |
| 2005/0285837 | A1 * | 12/2005 | Akimoto | 345/96 |
| 2007/0146279 | A1 * | 6/2007 | Oke et al. | 345/94 |
| 2009/0002301 | A1 * | 1/2009 | Koo et al. | 345/89 |

FOREIGN PATENT DOCUMENTS

| | | |
|---|---|---|
| JP | 2000-131666 | 5/2000 |
| JP | 2000-235375 | 8/2000 |
| JP | 2004-279626 | 10/2004 |

* cited by examiner

*Primary Examiner* — Lun-Yi Lao
*Assistant Examiner* — Tom Sheng
(74) *Attorney, Agent, or Firm* — McKenna Long & Aldridge, LLP

(57) ABSTRACT

The exemplary embodiment relates to a liquid crystal display device and a driving method thereof for reducing heat and electric consumption power of the data driving circuit. The exemplary embodiment includes: a liquid crystal display panel including a plurality of data lines crossing a plurality of gate lines and liquid crystal cells arranged in a matrix e; a timing controller generating a polarity control signal, deciding if a predetermined weak pattern data is input, and shifting a phase of the polarity control signal in a next frame period following a frame showing the weak pattern data when the weak pattern data is input; a data driving circuit reversing the polarity of the data voltage in response to the polarity control signal and supplying to the data lines; and a gate driving circuit supplying a gate pulse to the gate lines sequentially.

6 Claims, 22 Drawing Sheets

FIG. 3
REPLACEMENT SHEET
(Related art)
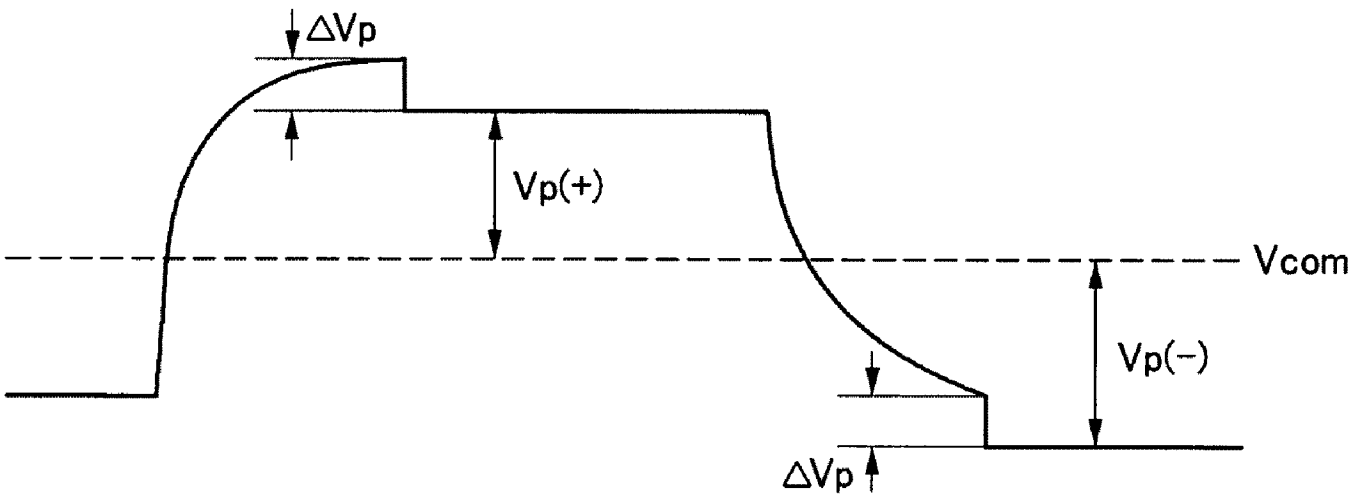

FIG. 4
REPLACEMENT SHEET
(Related art)
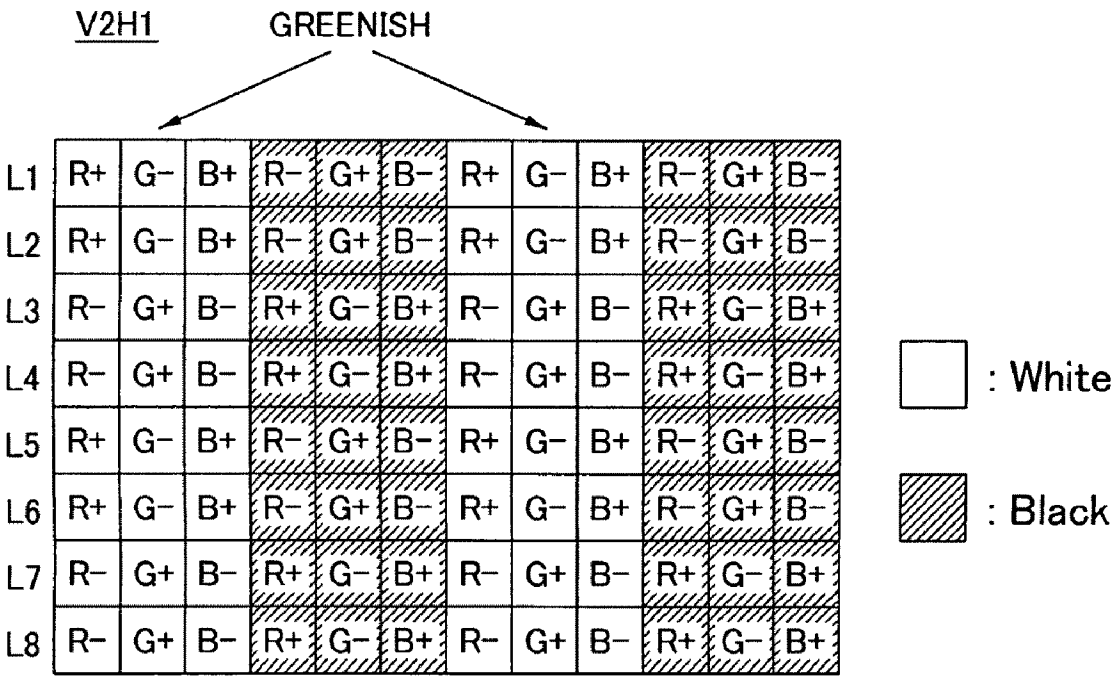

FIG. 5
REPLACEMENT SHEET
(Related art)
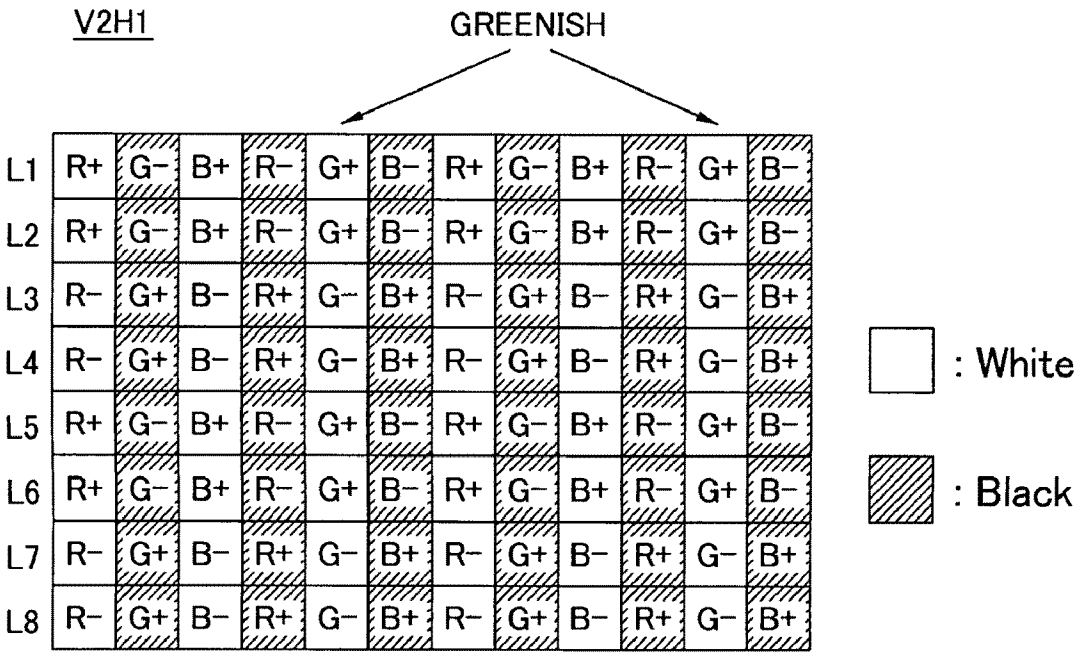

FIG. 6
REPLACEMENT SHEET
(Related art)
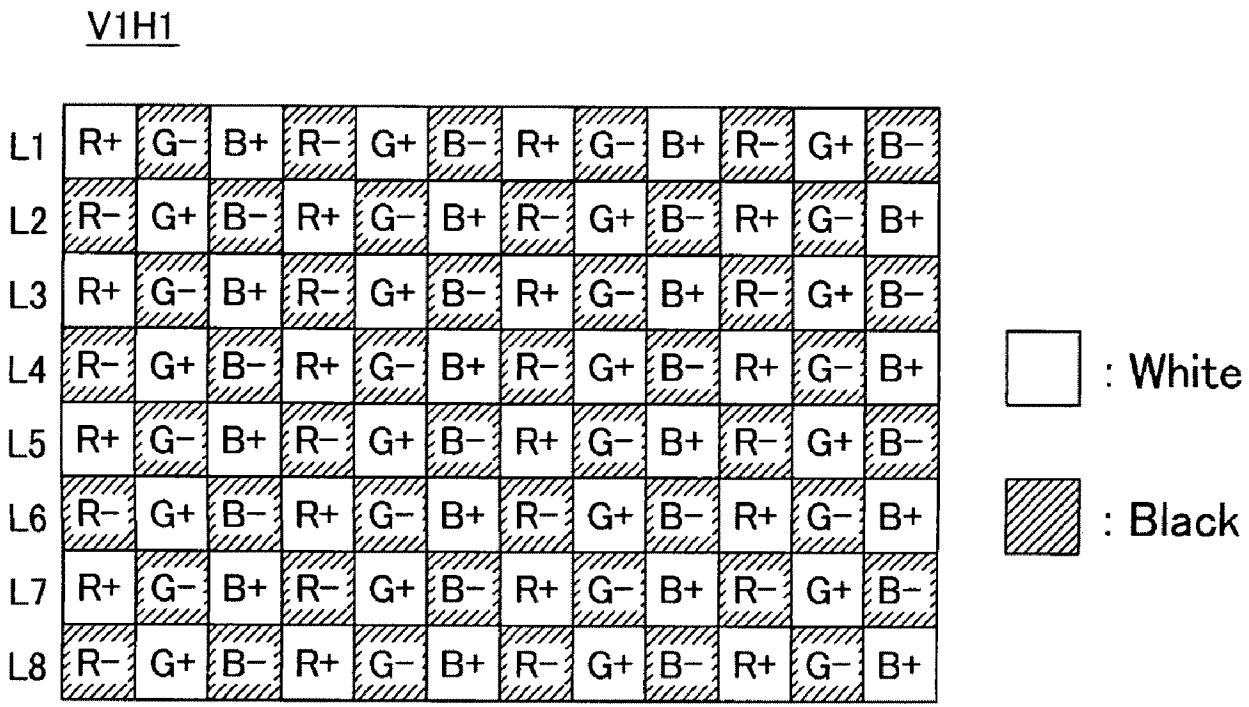

FIG. 7
REPLACEMENT SHEET
(Related art)
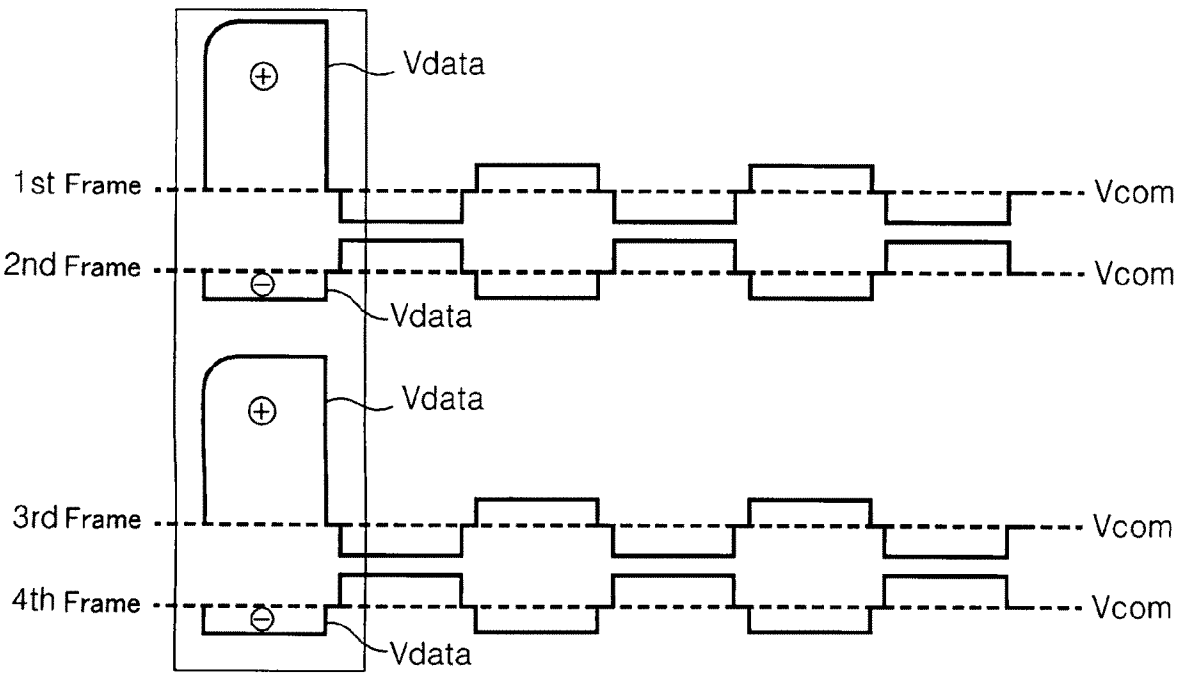

FIG. 12

| | | | | | | | | | | | | Result of Decision |
|---|---|---|---|---|---|---|---|---|---|---|---|---|
| L1 | W | W | W | W | G | ··· | G | W | W | W | W | W |
| L2 | B | B | B | B | W | ··· | B | B | G | G | B | B |
| L3 | G | G | G | B | B | ··· | W | W | W | W | G | W |
| L4 | B | B | B | B | B | ··· | B | B | G | B | B | B |
| L5 | G | G | G | G | B | ··· | G | G | G | G | W | G |

FIG. 13

| | MSB | | | | | | | LSB | |
|---|---|---|---|---|---|---|---|---|---|
| | b7 | b6 | b5 | b4 | b3 | b2 | b1 | b0 | |
| W | 1 | 1 | 1 | 1 | 1 | 1 | 1 | 1 | (255) |
| | 1 | 1 | 1 | 1 | 1 | 1 | 1 | 0 | (254) |
| | | | | | ⋮ | | | | |
| | 1 | 1 | 0 | 0 | 0 | 0 | 0 | 1 | (93) |
| | 1 | 1 | 0 | 0 | 0 | 0 | 0 | 0 | (92) |
| G | 1 | 0 | 1 | 1 | 1 | 1 | 1 | 1 | (191) |
| | 1 | 0 | 1 | 1 | 1 | 1 | 1 | 0 | (190) |
| | | | | | ⋮ | | | | |
| | 0 | 1 | 0 | 0 | 0 | 0 | 0 | 1 | (65) |
| | 0 | 1 | 0 | 0 | 0 | 0 | 0 | 0 | (64) |
| B | 0 | 0 | 1 | 1 | 1 | 1 | 1 | 1 | (63) |
| | 0 | 0 | 1 | 1 | 1 | 1 | 1 | 0 | (62) |
| | | | | | ⋮ | | | | |
| | 0 | 0 | 0 | 0 | 0 | 0 | 0 | 1 | (1) |
| | 0 | 0 | 0 | 0 | 0 | 0 | 0 | 0 | (0) |

LIQUID CRYSTAL DISPLAY AND DRIVING METHOD THEREOF

This application claims the benefit of Korean Patent Application No. 10-2008-0055419 filed on Jun. 12, 2008, which is incorporated herein by reference for all purposes as if fully set forth herein.

BACKGROUND OF THE INVENTION

1. Field of the Invention

The present invention relates to a liquid crystal display device (or "LCD device"). Especially, the exemplary embodiment relates to a liquid crystal display device and a driving method thereof for reducing heat and electric consumption power of the data driving circuit.

2. Discussion of the Related Art

The liquid crystal display device presents video images by controlling the light transparent ratio of the liquid crystal cells according to the input video signals. The active matrix type liquid crystal display device controls the video data actively by switching the voltage of the video data supplied to the liquid crystal cells using thin film transistors (TFTs) disposed at each liquid crystal cells (Clc) as shown in FIG. 1. Therefore, the active matrix type can ensures a high display quality. In the FIG. 1, the reference character "Cst" denotes a storage capacitor for maintaining the charged data voltage to the liquid crystal cell (Clc). The reference numerical 'D1' denotes data lines supplying the data voltages and the reference numerical 'G1' denotes gate lines supplying scan voltages.

To decrease offset components of the direct current and to reduce the degrade of the liquid crystal material, the liquid crystal display device is generally driven by the inversion method in which the polarity of data voltage applied to the neighboring liquid cells is opposite respectively and the polarity of data voltage applied to the same liquid cell is alternated in each frame. When the polarity of data voltage is alternated, the swing width of data voltage supplied to the data lines is large and the data driving circuit requires large electric current so that the data driving circuit is overheated and the consumption electric power will be increased.

To reduce the swing width of data voltage supplied to the data lines, to prevent the data driving circuit from being overheated and to reduce consumption electric power, was suggested that the charge share circuit or the precharging circuit is applied to the data driving circuits. However, the effect of this technique is not sufficiently met to the user's requirements.

FIG. 2 is the waveform illustrating the control of the data voltage using the conventional charge share circuit.

Referring to FIG. 2, the period of pulse of source output enable (SOE) signal for controlling the output of the data driving circuit is the 1 horizontal period. The data driving circuit supplies the charge share voltage to the data lines during the high logic period of the source output enable (SOE) signal, that is, during the pulse width period. During the low logic period of the source output enable (SOE) signal, the data driving circuit supplies positive or negative data voltage to the data lines. The data driving supplies the charge share voltage to the data line with synchronizing to the pulse of source output enable (SOE) signal in the frequency of the 1-horizontal period or the 2-horizontal period according to the kind of drive IC (integrated circuit), regardless of the polarity of the data voltage. In FIG. 2, the gate shift clock (GSC) signal is the clock signal for controlling the shift operation. The polarity control signal (POL) is the control signal for controlling the polarity of the data voltage outputted form the data driving circuit.

The charge share control generates the electric current of the data driving circuit smaller than the case in which the data voltage is supplied from the positive polarity data voltage to the negative polarity data voltage or vice versa. However, as the swing width of the data voltage after and before the charge share voltage, the electric current of the data driving circuit is still high. Especially, when the polarity of data voltage is changed and the polarity of data voltage is changed from the black scale value to the white scale value, the electric current flowing in the data driving circuit is rapidly increased.

When the polarity of the data voltage is alternated by the inversion method, the absolute amount of the charging voltage to the liquid crystal cell for the positive polarity data voltage and the absolute amount of the charging voltage to the liquid crystal cell for the negative polarity data voltage are different. Therefore, the display quality can be inferior.

This is explained referring to the FIG. 3. Assume that firstly the liquid cell is charged with the positive polarity data voltage (+Vp), and then it is charged with the negative polarity data voltage (−Vp) for representing the same gray-scale of the positive polarity data voltage (+Vp). After charging the positive polarity data voltage, the liquid cell holds the voltage (Vp(+)) of which absolute value is lowered with ΔVp by the parasitic capacitance of the TFT. Whilst, after charging the negative polarity data voltage, the liquid crystal cell holds the voltage (Vp(−)) of which absolute value is increased with ΔVp by the parasitic capacitance of the TFT. Therefore, the liquid cell of the normally black mode LCD device transmits the light with higher light transparent ratio when the negative polarity data voltage is charged than when the positive polarity data voltage is charged. In the normally black mode, the light transparent ration of the liquid crystal cell is increased as the voltage charged at the liquid crystal cell is higher. In the interim, the liquid crystal cell of the normal white mode LCD device transmits the light with lower light transparent ratio when the negative polarity data voltage is charged than when the positive polarity data voltage is charged. In the normally white mode, the light transparent ration of the liquid crystal cell is decreased as the voltage charged at the liquid crystal cell is lower.

The display quality of a liquid crystal display device may be degraded at certain data pattern according to the relationship between the polarity pattern of data voltage charged to the liquid crystal cells and the gray-scale value of the data. Hereinafter, this data pattern of degrade in a liquid crystal display device is defined as the "weakness pattern". The representative causes of the quality degrade are the greenish phenomenon on display screen and the flicker in which the luminescent of display panel is periodically changed.

The FIGS. 4 and 5 illustrate the representative examples for the weakness pattern of the greenish shown in the display screen.

Referring to FIG. 4, one example for the weakness pattern of the greenish is the data pattern in which the gray scale of the data supplied to the pixels of the odd columns are white and the gray scale of the data supplied to the pixels of the even columns are black. When this kind weakness pattern is inputted, further if the LCD device is driven in the Vertical 2-dot and Horizontal 1-dot inversion method (V2H1), the liquid crystal display device may have greenish pattern more easily. In the Vertical 2-dot and Horizontal 1-dot inversion method (V2H1), the polarity of the data voltages charged to the liquid crystal cells is inverted (altered) at every two vertical dots (or 2 liquid crystal cells) of the display panel and at every one horizontal dot (or 1 liquid crystal cell) in one frame period.

In FIG. 4, as all data voltages of green (G) data which mainly makes an effect to the luminescence among the red (R), green (G) and blue (B) data at $1^{st}$, $2^{nd}$, $5^{th}$, and $6^{th}$ lines (L1, L2, L5 and L6) are negative polarity data voltages, a greenish is shown at the lines. This greenish phenomenon is caused because the polarity of the green data has only one type (negative or positive) of polarity.

Referring to FIG. 5, for another example of the greenish weak pattern, the gray scale of the data supplied to the sub-pixels of the odd numbered columns is the white, and the gray scale of the data supplied to the sub-pixels of the even numbered columns is black. When this kind weakness pattern is inputted, further if the LCD device is driven in the Vertical 2-dot and Horizontal 1-dot inversion method (V2H1), the liquid crystal display device may have greenish pattern more easily.

FIG. 6 illustrates an example for occurring the weak pattern of flicker.

Referring to the FIG. 6, the example for the weak pattern of flicker is the mosaic pattern in sub-pixel unit in which the gray scale of data voltage of the every each other 1 pixel in horizontal and vertical directions is alternated with white and black gray scales. When this type of weakness pattern is inputted, further if the LCD is driven in the Vertical 1-dot and Horizontal 1-dot inversion method (V1H1), the display screen of this LCD panel can have flicker phenomenon easily. For the Vertical 1-dot and Horizontal 1-dot inversion method (V1H1), the data voltage of every neighboring liquid crystal cells in horizontal and vertical directions have reversed polarity respectively. In this case, all data voltages of the white gray scale in one frame period are positive data voltages and all data voltages of the white gray scale in the next farm period are also positive data voltages. Therefore, the luminescence of display screen can be changed in each frame period.

In addition, if the polarity of data voltage supplied to the liquid cell of the LCD device is kept in any one polarity for a long time, when the screen is changed, an incidental image in which the former image is shown incidentally can be appeared on the screen easily. As the incidental image phenomenon charges the same polarity voltage to the liquid cell continually, it is also defined as the "DC image sticking". One example of the incidental image is occurred when the interlace type data voltage is supplied to the LCD device. The interlace type data voltage (or interlace data) includes only the odd line data voltage supplied to the liquid cells in the odd lines for the odd frame period. Further, the interlace data includes only even line data voltage supplied to the liquid cells in the even lines for the even frame period.

FIG. 7 illustrates an example of the interlace data. Assume that the liquid cell supplied with the data voltage shown in FIG. 7 is any one of the liquid cell disposed in an odd line.

Referring to FIG. 7, for the odd frame period, the positive voltages are supplied to the liquid cells and the negative voltages are supplied to the liquid cells for the even frame period. In the interlace mode, the high positive data voltages are supplied to the liquid cells disposed in the odd lines only for the odd frame period. For 4 frame periods, the positive data voltages are superior to the negative data voltages as the waveform shown in the box, so that the DC image sticking is occurred.

FIG. 8 is the image illustrating the experience result of the DC image sticking occurred by the interlace data. If the original image as the left image shown in the FIG. 8 is supplied to the LCD panel for predetermined time period, the data voltage having the same polarity is repeatedly charge to the liquid cells. As a result, after the original image data as the left image of FIG. 8, a intermediated gray scale, for example 127 gray scale data voltage is supplied to all liquid cells of the LCD panel, the original image pattern will not be represented clearly, that is there is the DC image sticking is occurred.

For another example of the DC image sticking, when the same image is moved or scrolled with a constant speed, according to the relationship between the size of the scrolled (moved) picture and the scroll speed (moving speed) the same polarity voltage is repeatedly charge to the same liquid cells. As a result, there is a DC image sticking phenomenon. This example is as shown in FIG. 9. FIG. 9 is the image illustrating the experience result of the DC image sticking when a deviant crease line pattern and a text pattern are moving with constant speed.

SUMMARY OF THE INVENTION

Accordingly, the present invention is directed to a liquid crystal display and driving method thereof that substantially obviates one or more of the problems due to limitations and disadvantages of the related art.

An advantage of the present invention is to provide a liquid crystal display device and a method for driving thereof that reduces the heating and the consumption electric power of the data driving circuit.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a liquid crystal display panel includes: a liquid crystal display panel including a plurality of data lines crossing a plurality of gate lines and liquid crystal cells arranged in a matrix; a timing controller generating a polarity control signal, deciding if a predetermined weak pattern data is input, and shifting a phase of the polarity control signal in a next frame period following a frame showing the weak pattern data when the weak pattern data is input; a data driving circuit reversing the polarity of the data voltage in response to the polarity control signal and supplying to the data lines; and a gate driving circuit supplying a gate pulse to the gate lines sequentially.

In another aspect of the present invention, a liquid crystal display panel according to another exemplary embodiment includes: a liquid crystal display panel including a plurality of data lines crossing a plurality of gate lines and liquid crystal cells arranged in a matrix; a timing controller generating a polarity control signal, deciding if a predetermined weak pattern data and a DC image sticking data are input, and shifting a phase of the polarity control signal in a next frame period following a frame showing the weak pattern data when the weak pattern data and the DC image sticking data are input; a data driving circuit reversing the polarity of the data voltage in response to the polarity control signal, expanding a horizontal polarity inversion period of the data voltages in response to the dot inversion control signal, and supplying to the data lines; and a gate driving circuit supplying a gate pulse to the gate lines sequentially.

In another aspect of the present invention, a method for driving a liquid crystal display device includes: generating a polarity control signal; deciding if a predetermined weak pattern data is input, and shifting the polarity control signal within a next frame period showing the weak pattern data when the weak pattern data is input; reversing the polarity of data voltages by controlling a data driving circuit with the polarity control signal, and supplying the reversed data voltages to the data lines; and supplying a gate pulse to the gate line sequentially by controlling a gate driving circuit.

In another aspect of the present invention, a method for driving a liquid crystal display device includes: generating a polarity control signal; deciding if a predetermined weak pattern data and a DC image sticking data are input, and shifting a phase of the polarity control signal and activating a dot inversion control signal in a next frame period following a frame showing the weak pattern data when the weak pattern data and the DC image sticking data are input; reversing the polarity of the data voltage in response to the polarity control signal, expanding a horizontal polarity inversion period of the data voltages in response to the dot inversion control signal, and supplying to the data lines; and supplying a gate pulse to the gate line sequentially by controlling a gate driving circuit.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIG. 3 is the waveform illustrating the charged amount to the liquid cell at the positive and negative data voltages, respectively;

FIGS. 4 and 5 are waveforms illustrating the examples for the weak patterns of greenish on the video image of the liquid crystal display device;

FIG. 6 is one example for the weak pattern of flicker phenomenon on the video image of the liquid crystal display device;

FIG. 7 is the waveform illustrating the one example of the interlace data;

FIGS. 12 and 13 are diagrams for explaining the example of the gray scale analysis of the data analyzer shown in the FIG. 11;

DETAILED DESCRIPTION OF THE ILLUSTRATED EMBODIMENTS

Reference will now be made in detail to an embodiment of the present invention, example of which is illustrated in the accompanying drawings.

Figure 10:
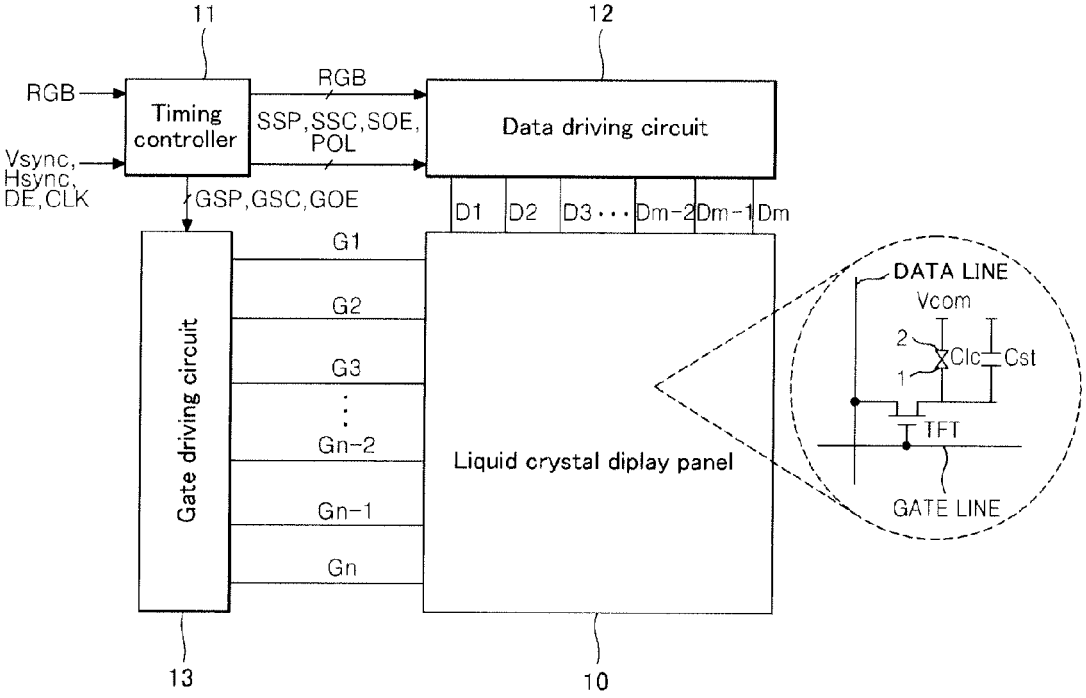
FIG. 10 is the block diagram illustrating the liquid crystal display device according to the first embodiment of the present disclosure.

Referring to FIG. 10, the liquid crystal display device according to the first embodiment of the present disclosure includes a liquid crystal display panel 10, a timing controller 10, a timing controller 11, a data driving circuit 12, and a gate driving circuit 13.

The liquid crystal display panel 10 includes two glass substrates joining each other and a liquid crystal layer there between. On the lower glass substrate of the liquid crystal display panel 10, data lines (D1 to Dm) and gate lines (G1 to Gn) are disposed crosswisely each other. The liquid crystal cells (Clc) are disposed in a matrix pattern of m×n on the liquid crystal display panel 10 having the crosswise structure of the data lines (D1 to Dm) and the gate lines (G1 to Gn).

On the lower glass substrate of the liquid crystal display panel 10, data lines (D1 to Dn), gate lines (G1 to Gn), TFTs at the area crossing the data lines and the gate lines, pixel electrodes of each liquid crystal cells (Clc) connected to TFTs, and storage capacitors (Cst) are formed. On the upper glass substrate of the liquid crystal display panel 10, a black matrix, a color filter, and a common electrode 2 are formed. The common electrode 2 is formed on the upper glass substrate for the vertical electric field driving type such as TN mode (Twisted Nematic mode) and VA mode (Vertical Alignment mode). On the contrary, for the horizontal electric field driving type such as IPS mode (In-Plane Switching mode) and FFS mode (Fringe Field Switching mode), the common electrode 2 is formed on the lower glass substrate with the pixel electrode 1.

On the outer surfaces of the upper and lower glass substrates of the liquid crystal display panel 10, polarization plates are attached, respectively. The light transparent axis of the polarization plates are perpendicularly disposed each other. On the inner surface of the upper and lower glass substrate of the liquid crystal display panel 10, alignment layers for pre-tilt angle of the liquid crystal material are formed.

The timing controller 11 receives timing signals such as the vertical synchronizing signal (Vsync), the horizontal synchronizing signal (Hsync), the data enable signal (DE), and the dot clock (CLK) and then generates the control signal for controlling the operating timing of the data driving circuit 12 and the gate driving circuit 13. The timing controller 11 counts the data enable signal (DE) generated with the frequency of the 1-horizontal period to decide the horizontal and vertical (or frame period). Therefore, the Vsync and Hsync may not be entered into the timing controller 11.

The control signals generated from the timing controller 11 includes a gate timing control signal for controlling the operating timing of the gate driving circuit 13 and a data timing control signal for controlling the operating timing of the data driving circuit 12.

The gate timing control signal includes the gate start pulse (GSP), the gate shift clock (GSC), the gate output enable (GOE), and so on. The gate start pulse (GSP) indicates the start horizontal line at which the scan is starting during a vertical period for showing one screen. The gate shift clock signal (GSC) is inputted into the shift register in the gate driving circuit 13 and outputted at every 1-horizontal period as the timing control signal for shifting the gate start pulse sequentially. The gate output enable signal (GOE) controls the output of the gate driving circuit 13.

The data timing control signal includes the source start pulse (SSP), the source sampling clock (SSC), the source enable signal (SOE), and the polarity control signal (POL). The source start pulse (SSP) indicates the start pixel in one horizontal line showing the data. The source sampling clock (SSC) indicates the latch operation of the data in the data driving circuit 12 based on the rising or falling edge. The source output enable signal (SOE) controls the output of the data driving circuit 12. The polarity control signal (POL) indicates the polarity of the data voltage supplied to the liquid cells (Clc) of the LCD panel 10.

The timing controller 11 analyzes the data for detecting the data which may have the weak pattern or the DC image sticking. When the weak pattern of DC image sticking is inputted, the timing controller 11 shifts the phase of the polarity control signal (POL) to reduce the consumption electric power and heating amount of the data driving circuit 12 and to enhance the quality of the video image.

The data driving circuit 12 latches the digital video data (RGB0 under the control of the timing controller 11. In response to the polarity control signal (POL), the data driving circuit 12 converts the digital video data (RGB) into the analogue positive/negative gamma compensation voltage. And then, it supplies the gamma compensation voltage to the data lines (D1 to Dm) as the data voltages. Further, the data driving circuit 12 synchronizes to the pulse of the source output enable signal (SOE) with the frequency of 2-horizontal period to supply the charge share voltage to the data lines (D1 to Dm). The charge share voltage is the average voltage generated when the data line supplied with a positive data voltage is shorted with the data line supplied with a negative data voltage. In the interim, the charge share voltage may be generated by the common voltage (Vcom). The common voltage (Vcom), as mentioned above, is the voltage equivalent to the common voltage supplied to the common electrode 2 opposite to the pixel electrode 1, and the middle voltage between the positive data voltage and the negative data voltage.

The gate driving circuit 13 includes a plurality of gate drive IC (integrated circuit) having the shift register, the level shifter for converting the output signal of the shift register into the signal having swing width proper to drive the TFT of the liquid cell, and output buffers connected between the level shifter and each gate lines (G1 to Gn). It outputs the scan pulses having pulse width of about 1-horizontal period sequentially.

Figure 11:
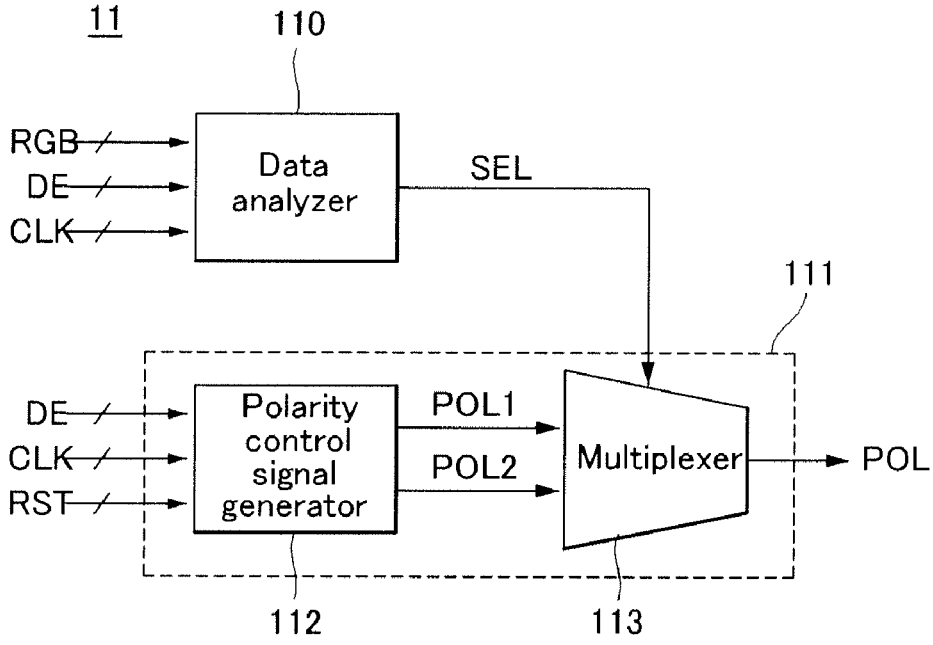
FIG. 11 is the block diagram illustrating circuit shifting the phase of the polarity control signal according to the result of the analyzing data of the timing controller shown in the FIG. 10.

FIG. 11 illustrates the circuit diagram for analyzing the data and for shifting the phase of the polarity control signal according to the result of the analysis in the timing controller 11.

Referring to FIG. 11, the timing controller 11 includes a data analyzer 110 and a phase controller 11.

The data analyzer 110 receives the digital video data (RGB), the data enable signal (DE), and the dot clock signal (CLK). The data enable signal (DE) indicates the effective data period of the data voltage charged to one line for one horizontal period, and it is generated with the frequency of the 1-horizontal period. The dot clock (CLK) is the clock signal for sampling each data of data enable signal (DE). The data analyzer 110 counts the data enable signal (DE) to decide the line of the digital video data (RGB) currently inputted and performs the sampling to the digital video data (RGB) with the dot clock (CLK). The data analyzer 110 decides the representative gray scale of each digital video data (RGB) and the representative gray scale of the digital video data (RGB) included into each line to determine the weak pattern. Based on the analysis of the input data, when any weak pattern is inputted, the data analyzer 110 will reverse the logic value of the selection signal (SEL) in a blank period prior to the next frame period showing the data of the weak pattern.

When the data other than weak pattern, the phase controller 111 outputs the first polarity control signal (POL 1) under the control of the data analyzer 110. When the data of weak pattern is inputted, the phase controller 111 outputs the second polarity control signal (POL 2).

The phase controller 111 includes a polarity control signal generator 112 and a multiplexer 113. The polarity control signal generator 112 counts the data enable signal (DE) to generates the first polarity control signal (POL 1) of which logic is inverted with the frequency of the 2-horizontal period. Further, it generates the second polarity control signal (POL 2) of which waveform has phase difference of 1-horizontal period to the first polarity control signal (POL 1). The polarity control signal generator 112 will be reset at every frame according to the reset signal (RST) to initialize the first and the second polarity signals (POL 1 and POL 2). The second polarity control signal (POL 2) has phase different from the phase of the first polarity control signal (POL 1). The alternating frequency of the logic of the second polarity control signal (POL 2) is the 2-horizontal period, the same as the first polarity control signal (POL 1). During the odd frame period, the first polarity control signal (POL 1) has the waveform having high logic (H) for $i^{th}$ horizontal period ('i' is natural number), the high logic (H) for $(i+1)^{th}$ horizontal period, the low logic (L) for $(i+2)^{th}$ horizontal period, and the low logic (L) for $(i+3)^{th}$ horizontal period, and repeating this pattern. In the interim, during the even frame period, the first polarity control signal (POL 1) has the waveform having low logic (L) for $i^{th}$ horizontal period ('i' is natural number), the low logic (L) for $(i+1)^{th}$ horizontal period, the high logic (H) for $(i+2)^{th}$ horizontal period, and the high logic (H) for $(i+3)^{th}$ horizontal period, and repeating this pattern. During the odd frame period, the second polarity control signal (POL 2) has the waveform having high logic (H) for $i^{th}$ horizontal period, the low logic (L) for $(i+1)^{th}$ horizontal period, the low logic (L)

for $(i+2)^{th}$ horizontal period, and the high logic (H) for $(i+3)^{th}$ horizontal period, and repeating this pattern. In the interim, during the even frame period, the second polarity control signal (POL 2) has the waveform having low logic (L) for $i^{th}$ horizontal period ('i' is natural number), the high logic (H) for $(i+1)^{th}$ horizontal period, the high logic (H) for $(i+2)^{th}$ horizontal period, and the low logic (L) for $(i+3)^{th}$ horizontal period, and repeating this pattern.

The multiplexer 113 selects any one of the first polarity control signal (POL 1) and the second polarity control signal (POL 2) in response to the selection signal (SEL) inputted from the data analyzer 110. The multiplexer 113 supplies the first polarity control signal (POL 1) to the data driving circuit 12 when the weak pattern is not inputted. When the weak pattern is inputted in response to the selection signal (SEL), it selects the second polarity control signal (POL 2) and supplies it to the data driving circuit 12.

FIG. 12 illustrates one example for the gray scale of the data supplied to the liquid cells disposed in the 5 lines. FIG. 13 illustrates the gray scale of the digital video data.

The data analyzer 110 decides the gray scale of each data included in each line, and the representative gray scale of each line. For example, if there are 1366 data in one line, and the data more than 50% among them, i.e., 683 data have the white gray scale (W), then the data analyzer 110 decides that, as shown in FIG. 12, the representative gray-scale of the lines (L1 and L3) are White gray scale (W). If the data more than 50% among one line data have Gray gray-scale (G), then the data analyzer 110 decides that the representative gray-scale of the line (L5) is the Gray gray-scale (G). In the interim, if the data more than 50% among one line data have the Black gray scale (B), then the data analyzer 110 decides that the representative gray-scale of the lines (L2 and L4) are the Black gray-scale (B). Here, the decision criteria, i.e., 50% may be other value, for example, 33%, 45%, 49%, 55%, or 66% according to the driving characteristics of the liquid crystal display device.

The gray scale of the data is decided by the 2 bits of the most significant bit (MSB) as shown in FIG. 13. When one data consists of 8 bits, the MSB of the high gray scale included into 192~255 gray scale range is "11", the MSB of the middle gray scale included into 64~191 gray scale range is "10" or "01", and the MSB of the low gray scale included into 0~63 gray scale range is "00". Therefore, the data analyzer 110 decides the gray scale of certain digital video data of which MSB of certain digital video data is "11" as the white gray scale (W). If the MSB of the digital video data (RGB) is "10" or "01", then the data analyzer 110 decides as Gray gray-scale. And, if the MSB of the digital video data (RGB) is "00", ten the data analyzer 110 decides the gray scale of the data as the Black gray scale (B).

When any one representative gray-scale among neighboring lines is the White gray-scale (W) and other representative gray-scale of other line is the Black gray-scale, further if these lines are over a predetermined number, for example 40 lines, and less than total line number, then the data analyzer 110 decides the frame data including these data as a weak pattern data.

Figure 14:
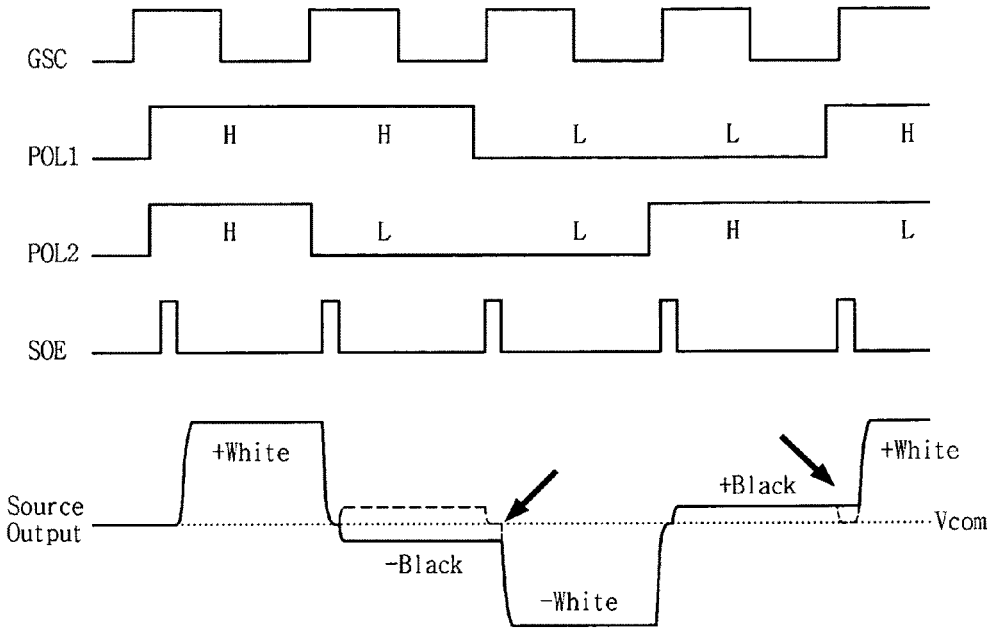
FIG. 14 is the waveform illustrating the phase of the data voltage and the polarity control signal when the phase of the polarity control signal is changed to the phase of the second polarity control signal at the next frame showing the data of the weak pattern.

FIG. 14 is a waveform illustrating an example for changing phase of the polarity control signal when a weak pattern data is inputted.

The timing controller 11 changes the phase of the polarity control signal (POL) from the first polarity control signal (POL 1) to the second polarity control signal (POL 2) at the frame inputting the weak pattern.

Then, the data driving circuit 12 supplies the voltage to the data line with the sequence of the charge share voltage, the positive polarity White gray-scale data voltage, the charge share voltage, the negative polarity Black gray-scale data voltage, the negative polarity White gray-scale data voltage, the charge share voltage, the positive polarity Black gray-scale data voltage, and the negative polarity White gray-scale data voltage in response to the second polarity control signal (POL 2) as shown in FIG. 14, when the weak pattern is inputted.

The conventional charge sharing operation performs the charge sharing between the data and the data unconditionally. In this case, all data voltages supplied to the data lines (D1 to Dm) are the common voltage (Vcom), however, as the common voltage is increasing from the charge sharing voltage, the swing width of the data voltage supplied to the data lines (D1 to Dm) will be increased and the number of rising edges will be increased. Therefore, the data driving circuit 12 gets more heating and the consumption electric power is increased.

On the contrary, in the present disclosure, only the phase of the polarity control signal (POL) is controlled differently when the weak pattern is inputted so that the charge sharing is performed only when the gray-scale of the data is changed from the White to the Black and the polarity of the data voltage is reversed, but the charge sharing is not performed when the data voltage is changed from the Black gray-scale voltage to the White gray-scale voltage of which polarity is reversed, as shown at the arrow mark. Therefore, the exemplary embodiment can reduce the swing width of the data voltage supplied to the data line, the number of the rising edge, and the power consumption and heating of the data driving circuit 12 when the weak pattern is inputted.

Figure 15:
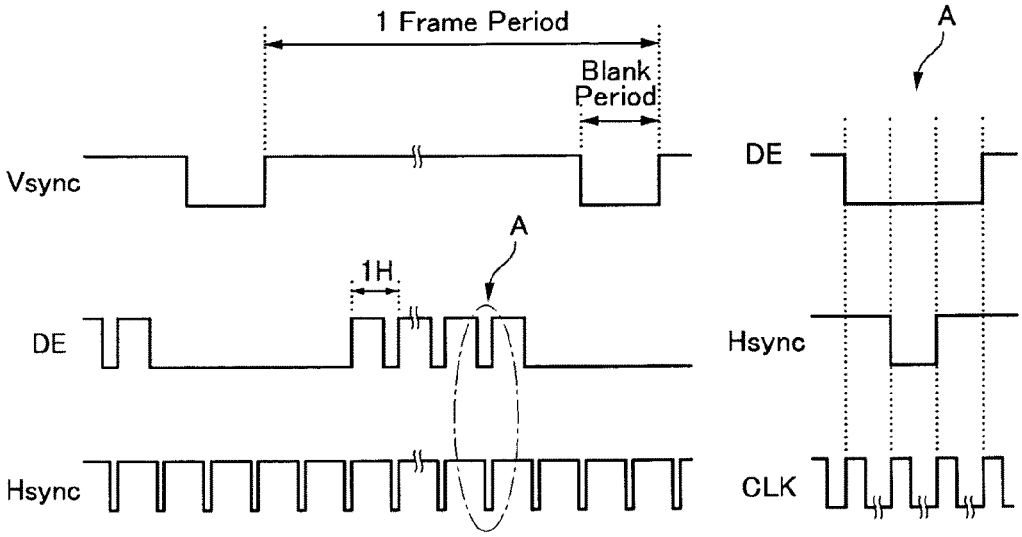
FIG. 15 is the waveforms of the timing signals showing the blank period between the horizontal periods, and the blank period between the frame periods.

The timing controller 11, as shown in FIG. 15, analyzes the data of one line included in the data enable signal (DE) for the blank period between the data enable signals to decide the representative gray scale of the line. Further, the timing controller 11 repeats the above operation to detect the weak pattern. When detecting the weak pattern, within the blank period prior to the frame period following the input of the weak pattern, the timing controller 11 changes the phase of the polarity control signal (POL) to the second polarity control signal (POL 20.

Figure 16:
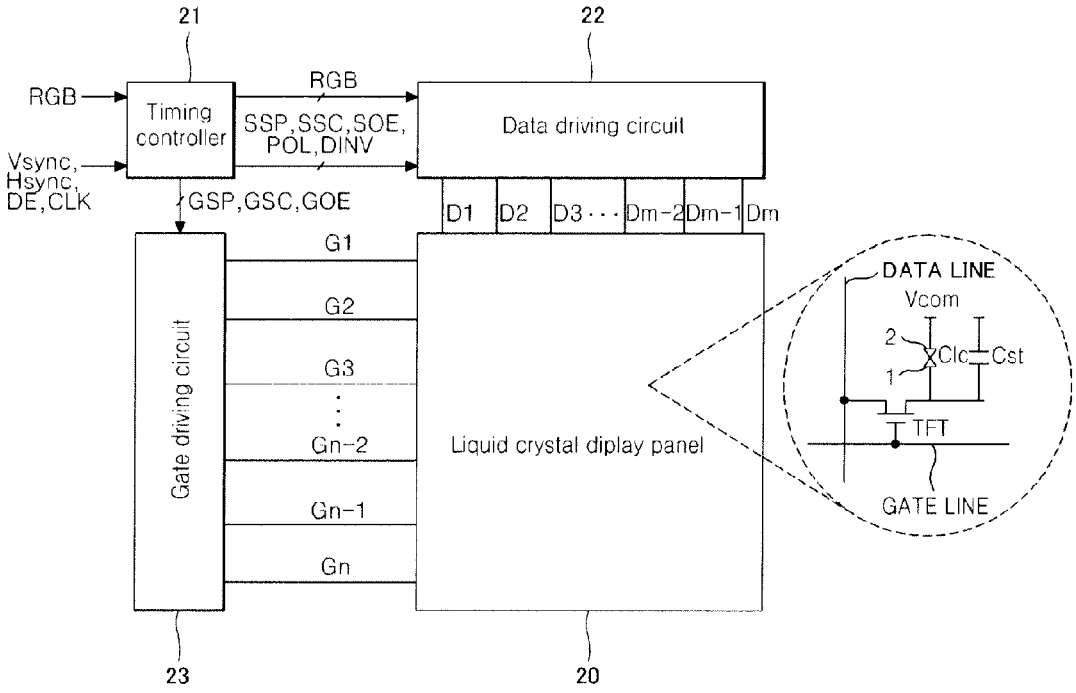
FIG. 16 is a block diagram illustrating a liquid crystal display device according to the second embodiment of the present disclosure.

FIG. 16 illustrates a liquid crystal display device according to the second embodiment of the present disclosure.

Referring to FIG. 16, the liquid crystal display device according to the second embodiment of the present disclosure includes a liquid crystal display panel 20, a timing controller 21, a data driving circuit 22, and a gate driving circuit 23.

The liquid crystal display panel 20 and the gate driving circuit 23 of the second embodiment are the same with those of the first embodiment, so that detail explain about them will not be mentioned.

The timing controller 21 receives timing signals such as the vertical synchronizing signal (Vsync), the horizontal synchronizing signal (Hsync), the data enable signal (DE), and the dot clock (CLK), and generates the data timing control signal and the gate timing control signal, and then supplies the digital video data (RGB) to the data driving circuit 22. The gate timing signal is the substantially same as that of the first embodiment. The data timing control signal includes the source start pulse (SSP), the source shift clock (SSC), the source output enable signal (SOE), the polarity control signal (POL), and the dot inversion control signal (DINV) for controlling the horizontal polarity reversing period of the data voltages outputted from the data driving circuit.

The timing controller 21 analyzes the inputted digital video data (RGB) to detect the data which may have the weak pattern data or the DC image sticking data from the inputted data. Here, the weak pattern includes the data pattern in which the White gray scale data and the Black gray scale data are alternately disposed in horizontal direction, as shown in FIGS. 4 to 6. When a weak pattern is inputted, the timing controller 21 shifts the phase of the polarity control signal (POL) and reverses the dot inversion control signal (DINV) at the same time.

The data driving circuit 22 latches the digital video data (RGB) under the control of the timing controller 21, converts the digital video data (RGB) to the positive/negative gamma compensation voltages in response to the polarity control signal (POL), and supplies the gamma compensation voltage to the data lines (D1 to Dm). Further, the data driving circuit 12 supplies the charge share voltage to the data lines (D1 to Dm) in synchronizing with the pulse of the source output enable signal (SOE) with the frequency of the 2-horizontal period. When the dot inversion control signal (DINV) has the high logic, the data driving circuit 22 reverses the polarity of the data voltages by the horizontal 2 dot inversion method, that is, at every 2 dots (or liquid cells) in horizontal direction. When the dot inversion control signal (DINV) is low logic, the data driving circuit 22 reverses the polarity of the data voltages with the horizontal 1 dot period.

Figure 17:
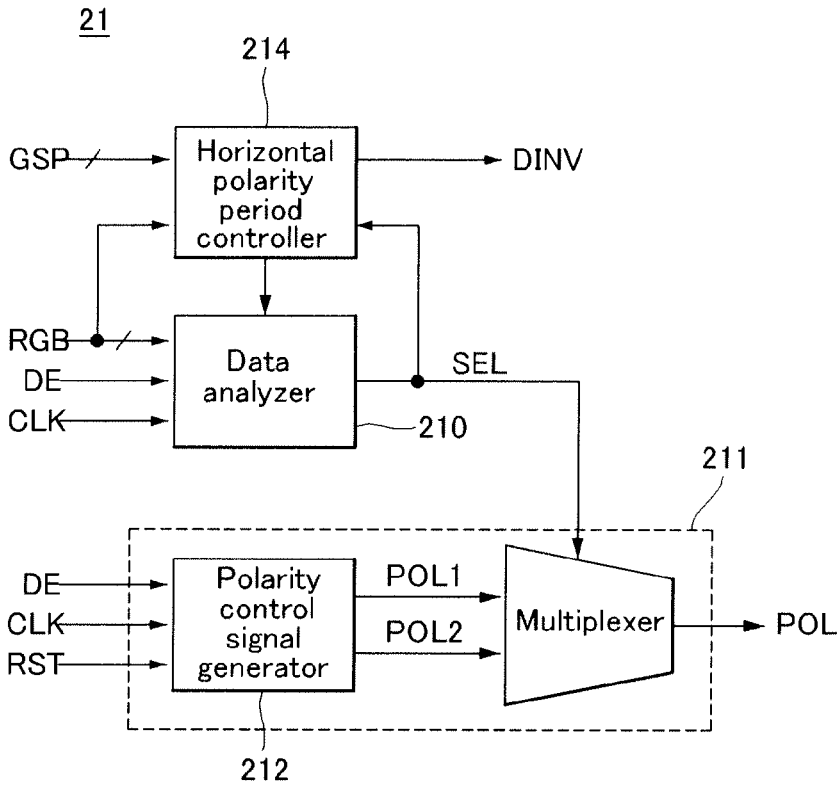
FIG. 17 is a block diagram illustrating a data analyzing, a shift circuit of polarity control signal and a control circuit for the horizontal polarity reversing period of the polarity control signal at the timing controller shown in FIG. 16.

Referring to FIG. 17, the timing controller 21 includes the data analyzer 210, the phase controller 211, and the horizontal polarity period controller 214.

The data analyzer 210 receives the digital video data (RGB), the data enable signal (DE) and the dot clock (CLK). The data analyzer 210 counts the data enable signal (DE) to decide the inputted digital video data (RGB), and to sample the digital video data (RGB) with the dot clock (CLK).

Further, the data analyzer 210 decides the gray scale of each digital video data (RGB) and the representative gray scale of the digital video data (RGB) included in any one line to detect the weak pattern based on these gray scales. When any weak pattern is inputted based on the analysis of the input data, the data analyzer 210 reverses the logic of the selection signal (SEL) within the blank period prior to the next frame period showing the weak pattern data. Further, in response to the decision result of the image inputted from the horizontal polarity period controller 224, when the data which may have the interlace data as shown in FIG. 7 or the DC image sticking of the scroll data as shown in FIG. 9, the data analyzer 210 reverses the logic of the selection signal (SEL) within the blank period prior to the next frame period showing the data and reverses the logic of the selection signal (SEL) periodically, for example with 1 frame period.

Figure 24:
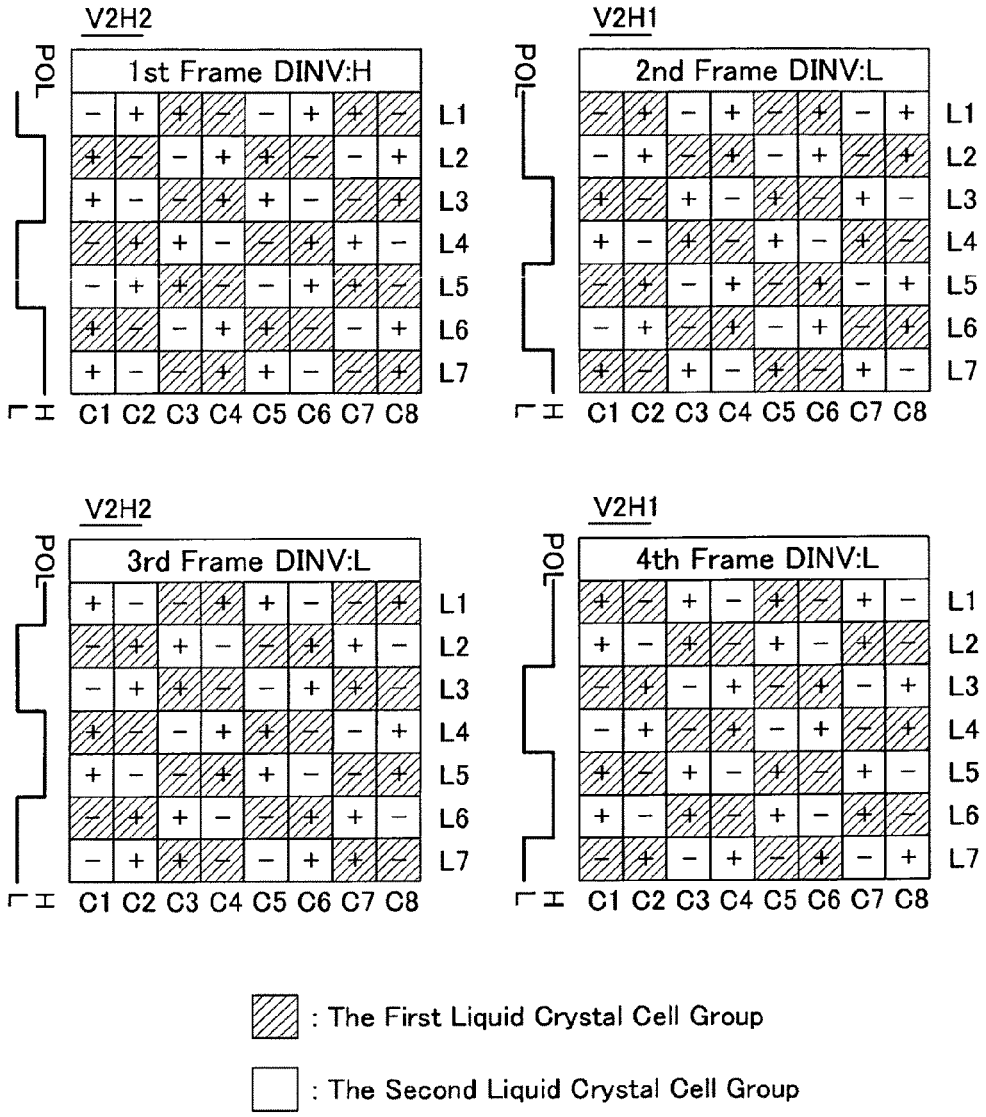
FIG. 24 is a diagram illustrating the polarity changes of the data voltages supplied to the liquid crystal display device according to the second embodiment.

When any weak pattern is not inputted, under the control of the data analyzer 210, the phase controller 211 outputs the first polarity control signal (POL 1) as shown in the FIG. 14. When weak pattern data is inputted, the phase controller 221 outputs the second polarity control signal (POL 2) as shown in FIG. 14 to shift the phase of the polarity control signal (POL). Further, when data which may have the DC image sticking phenomenon is inputted, the phase controller 221 outputs the second polarity control signal (POL 2) as shown in FIG. 14 to shift the phase of the polarity control signal (POL). After that, in response to the selection signal (SEL), it outputs the first polarity control signal (POL 1) and the second polarity control signal (POL 2) alternately periodically, for example with the frequency of the 1 frame period, to shift the polarity control signal (POL) as shown in FIG. 24.

The phase controller 211 includes the polarity control signal generator 212 and the multiplexer 213. The polarity control signal generator 212 counts the data enable signal (DE) to generate the first polarity control signal (POL 1) of which logic is alternated with the 2-horizontal period, and the second polarity control signal (POL 2) having the phase difference of 1 horizontal period to the first polarity control signal (POL 1). The multiplexer 213 selects any one of the first polarity control signal (POL 1) and the second polarity control signal (POL 2) in response to the selection signal (SEL) inputted from the data analyzer 210. When any weak pattern is not detected, the multiplexer 213 supplies the first polarity control signal (PO: 1) to the data driving circuit 22. When weak pattern is inputted, in response to the selection signal (SEL), it selects the second polarity control signal (POL 2) and supplies it to data driving circuit 22. According to the selection signal (SEL) reversing periodically, it outputs the first and the second polarity control signals (POL 1 and POL 2) alternately.

Figure 9:
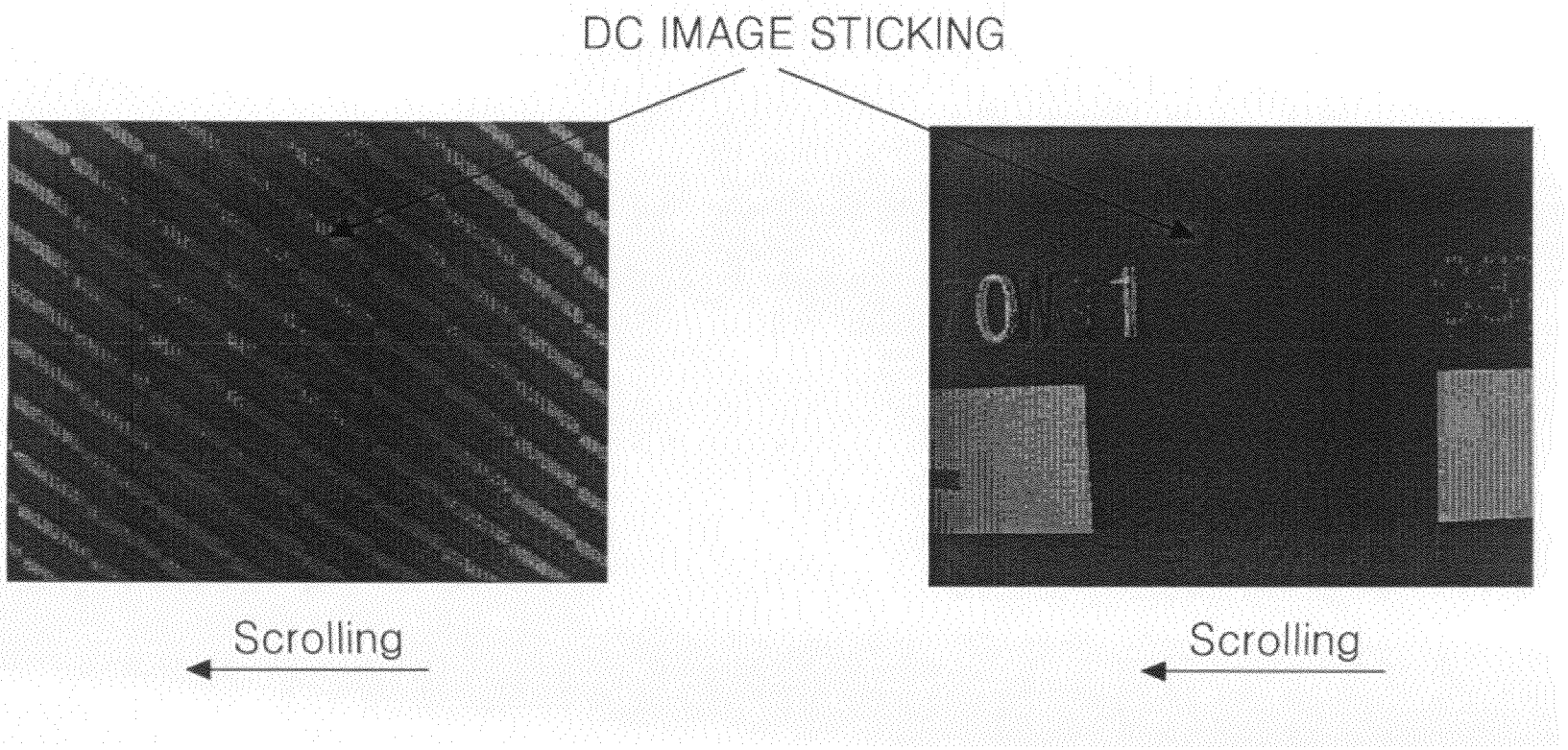
FIG. 9 (Related art)
FIG. 9 is the picture illustrating the experience result of the DC image sticking due to the scroll data.

The horizontal polarity period controller 214 receives the digital video data (RGB) and analyzes the data to decide if the data is any one of the interlace data as shown in FIG. 7 or the DC image sticking data of scroll data as shown in FIG. 9. When DC image sticking data is inputted, within the black period prior to the frame period following the frame showing the data, the dot inversion control signal (DINV) is reversed to the HIGH logic and the dot inversion control signal (DINV) is reversed periodically for example, with the frequency of the 1 frame period as shown in FIG. 24. Further, when weak pattern is inputted, in response to the selection signal (SEL) from the phase controller 211, the horizontal polarity period controller 214 reverses the dot inversion control signal (DINV) to the High logic within the blank period prior to the frame period following the frame showing the data.

The dot inversion control signal (DIVN) expands the polarity inversion period of the horizontal direction data voltages, that is line direction data voltages, from the 1-dot to the 2-dot. Further, when DC image sticking is inputted, the horizontal polarity period controller 214 controls the data analyzer 210 so that the logic of the selection signal (SEL) for controlling the phase controller 211 is reversed.

Figure 18:
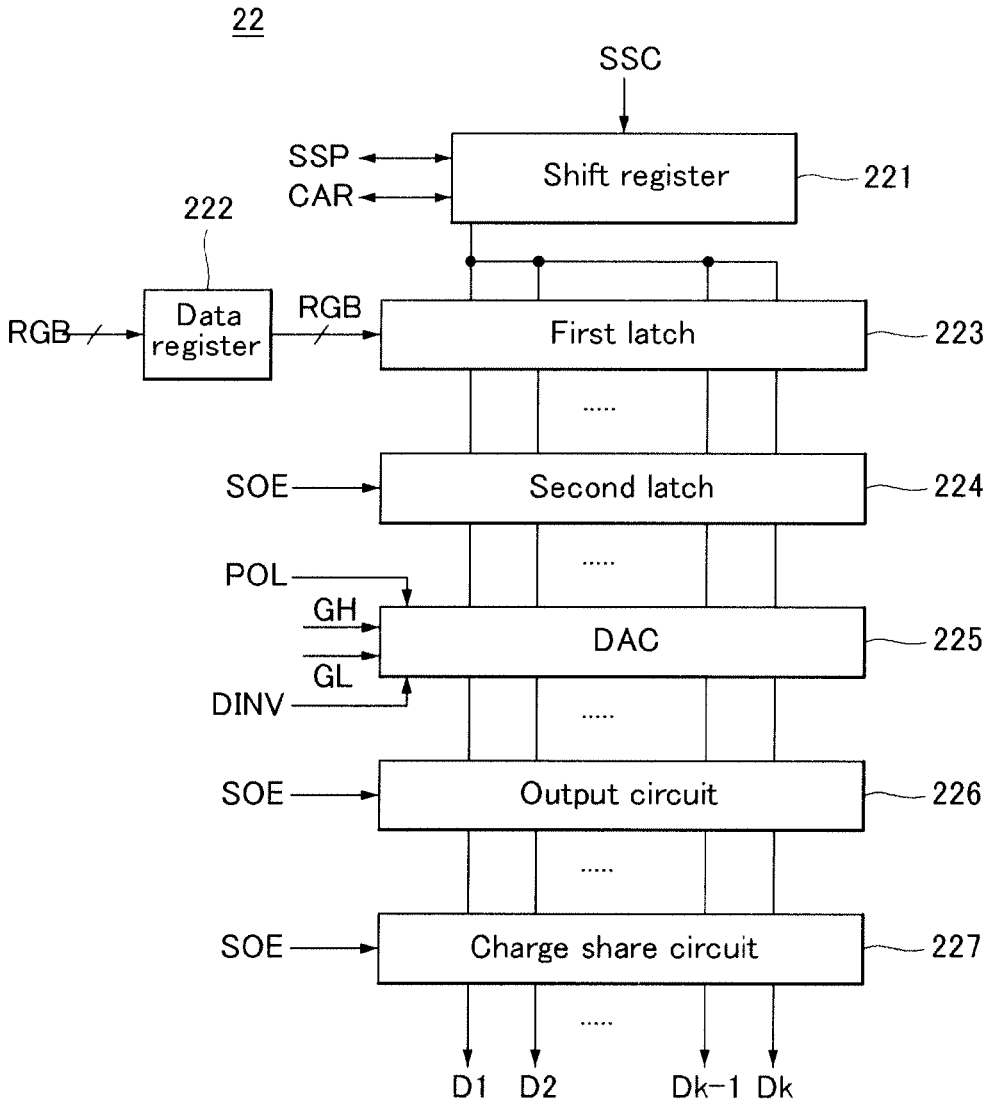
FIG. 18 is a circuit diagram illustrating a data driving circuit shown in FIG. 16, in detail.

FIG. 18 illustrates the data driving circuit 22 in detail.

Referring to FIG. 18, the data driving circuit 22 includes a plurality of integrated circuit (IC) for driving each k data lines (here, k is an integer smaller than m). Each IC includes the shift register 221, the data register 222, the first latch 223, the second latch 224, the digital/analogue converter (or "DAC"), the output circuit 226 and the charge share circuit 227.

The shift register 221 generates a sampling signal by shifting the source start pulse (SSP) from the timing controller 21 according to the source sampling clock (SSC). Further, the shift register 221 shifts the source start pulse (SSP) to transmit the carry signal (CAR) to the shift register 221 of the next IC. The data register 222 temporarily stores the digital video data (RGB) from the timing controller 21 and supplies the stored data (RGB) to the first latch 223. The first latch 223 performs the sampling operation to the digital video data (RGB) from the data register 222 in response to the sampling signal inputted from the shift register 221 sequentially, latches the data (RGB), and then outputs the data at the same time. The second latch 224 latches the data from the first latch 223, and outputs the digital video data with other digital video data latched by other second latches 224 of the other ICs for low logic period of the source output enable signal (SOE), at the same time.

Figure 19:
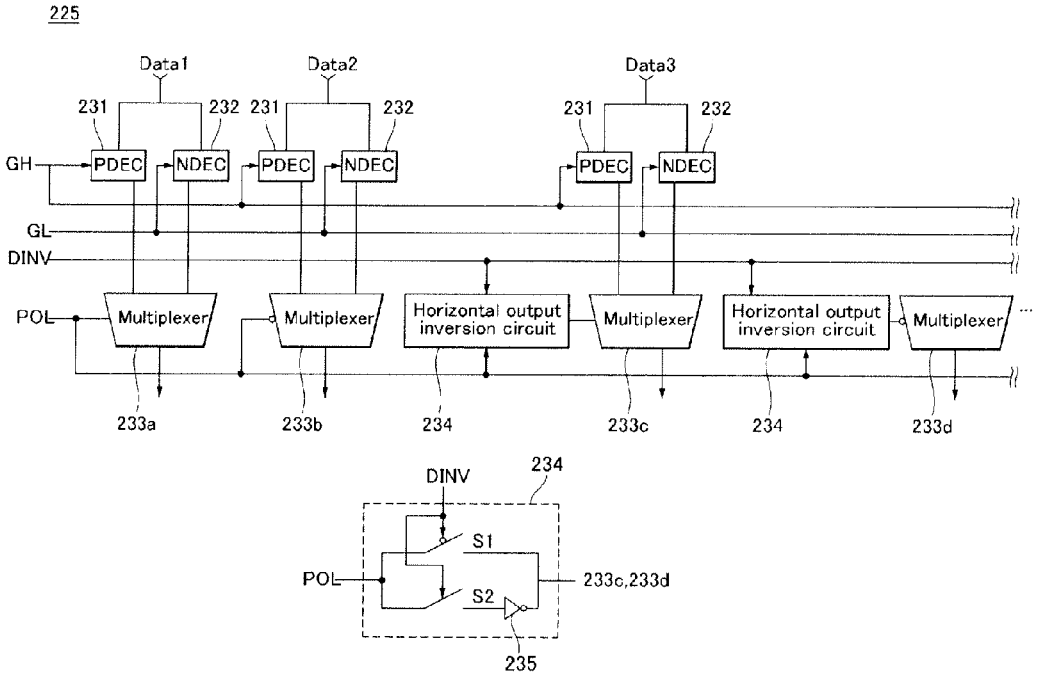
FIG. 19 is a circuit diagram illustrating the DAC shown in FIG. 18, in detail.

The DAC 225 includes the circuit shown in FIG. 19. The DAC 225 converts the digital video data from the second latch 224 into the positive gamma compensation voltage (GH) or the negative gamma compensation voltage (GL) in response to the polarity control signal (POL) and the dot inversion control signal (DINV) to generate analogue positive/negative data voltages. The polarity control signal (POL) decides the polarity of the liquid cells neighboring vertically and the dot inversion control signal (DINV) decides the polarity of the liquid cells neighboring horizontally. Therefore, the period of the vertical dot inversion is decided by the reversing period of the polarity control signal (POL), and the period of the horizontal dot inversion is decided by the dot inversion control signal (DINV).

The output circuit 226 includes buffers to minimize the signal damping of the analogue voltage supplied to the data lines (D1 to Dk).

The charge share circuit 227 having the frequency of the 2-horizontal period supplies the charge share voltage or the common voltage (Vcom) to the data lines (D1 to Dk) in synchronizing to the high logic period of the source enable signal (SOE).

FIG. 19 is a circuit diagram illustrating the DAC 225 in detail.

Referring to FIG. 19, the DAC 225 according to the embodiment of this disclosure includes a P-decoder (PDEC) 231 supplying the positive gamma compensation voltage (GH), a N-decoder (NDEC) 232 supplying the negative gamma compensation voltage (GL), and multiplexers 233*a* to 233*d* selecting the output from the P-decoder 231 and the N-decoder 232 in response to the polarity control signal (POL) and the dot inversion control signal (DINV).

The DAC 225 includes a horizontal output inversion circuit 234 reversing the logic of the selection control signal supplied to the control terminal of the multiplexers 233*c* and 233*d* in response to the dot inversion control signal (DIVN).

The P-decoder 231 decodes the digital video data inputted from the second latch 224 and outputs the positive gamma compensation voltage relating to the gray scale of the data. The N-decoder 232 decodes the digital video data inputted from the second latch 224 and outputs the negative gamma compensation voltage relating to the gray scale of the data. P-

The multiplexers 233*a* to 233*d* further include the $(4i+1)^{th}$ and the $(4i+2)^{th}$ multiplexers 233*a* and 233*b* directly controlled by the polarity control signal (POL), and the $(4i+3)^{th}$ and $(4i+4)^{th}$ multiplexers 233*c* and 233*d* controlled by the horizontal output inversion circuit 234.

The $(4i+1)^{th}$ multiplexer 233*a* alternately selects and outputs the positive gamma compensation voltage and the negative gamma compensation voltage in response to the polarity control signal (POL) inputted to its non-inversion control terminal. The $(4i+2)^{th}$ multiplexer 233*b* alternately selects and outputs the positive gamma compensation voltage and the negative gamma compensation voltage in response to the polarity control signal (POL) inputted into its inversion control terminal. The $(4i+3)^{th}$ multiplexer 233*c* alternately selects and outputs the positive gamma compensation voltage and the negative gamma compensation voltage in response to the output of the horizontal output inversion circuit 234 inputted to its non-inversion control terminal. The $(4i+4)^{th}$ multiplexer 233*d* alternately selects and outputs the positive gamma compensation voltage and the negative gamma compensation voltage in response to the output of the horizontal output inversion circuit 234 inputted to its non-inversion control terminal.

The horizontal output inversion circuit 234 includes switch elements S1 and S2, and an inverter 235. The horizontal output inversion circuit 234 controls the logic value of the selection control signal supplied to the control terminal of the $(4i+3)^{th}$ multiplexer 233*c* and the $(4i+4)^{th}$ multiplexer 233*d* in response to the dot inversion control signal (DINV). The inverter 235 is connected to the output terminal of the second switch element S2 and to the inversion/non-inversion control terminal of the $(4i+3)^{th}$ multiplexer 233*c* or the $(4i+4)^{th}$ multiplexer 233*d*. When the dot inversion control signal (DINV) has the high logic, the second switch element S2 turns on but the first switch element S1 turns off. Then, the reversed polarity control signal (POL) is inputted into the non-inversion control terminal of the $(4i+3)^{th}$ multiplexer 233*c*. Whilst, the reversed polarity control signal (POL) is also inputted into the inversion control terminal of the $(4i+4)^{th}$ multiplexer 233*d*. When the dot inversion control signal (DINV) has low logic, then the first switch element (S1) turns on but the second switch element (S2) turns off. Then, the original polarity control signal (POL) is inputted into the non-inversion control terminal of the $(4i+3)^{th}$ multiplexer 233*c*. Whilst, the original polarity control signal (POL) is also inputted into the inversion control terminal of the $(4i+4)^{th}$ multiplexer 233*d*.

If the polarity control signal (POL) is reversed with the vertical 2-dot period, that is 2-horizontal period and the dot inversion control signal (DINV) is low logic (L), the horizontal polarity of the odd lines of the data voltage supplied to the data lines will change as "+−+−" for Nth frame period, and as "−+−+" for $(N+1)^{th}$ frame period. Therefore, when the dot inversions control signal has low logic (L), the LCD device is driven in the Horizontal 2-dot and Vertical 1-dot inversion mode (V2H1).

When the weak pattern or the DC image sticking data is inputted, the phase of the polarity control signal (POL) is shifted with the 1-horizontal period. At the same time, the dot inversion control signal (DINV) is reversed to the low logic. When the polarity control signal (POL) of which phase is shifted is inputted, the consumption electric power and heating amount can be reduced or lowered. Further, in response to the activated dot inversion control signal (DINV), the data driving circuit 22 expands the horizontal polarity inversion period of the data voltages to minimize the degraded image quality due to the input of the weak pattern or the DC image sticking data.

Figure 20:
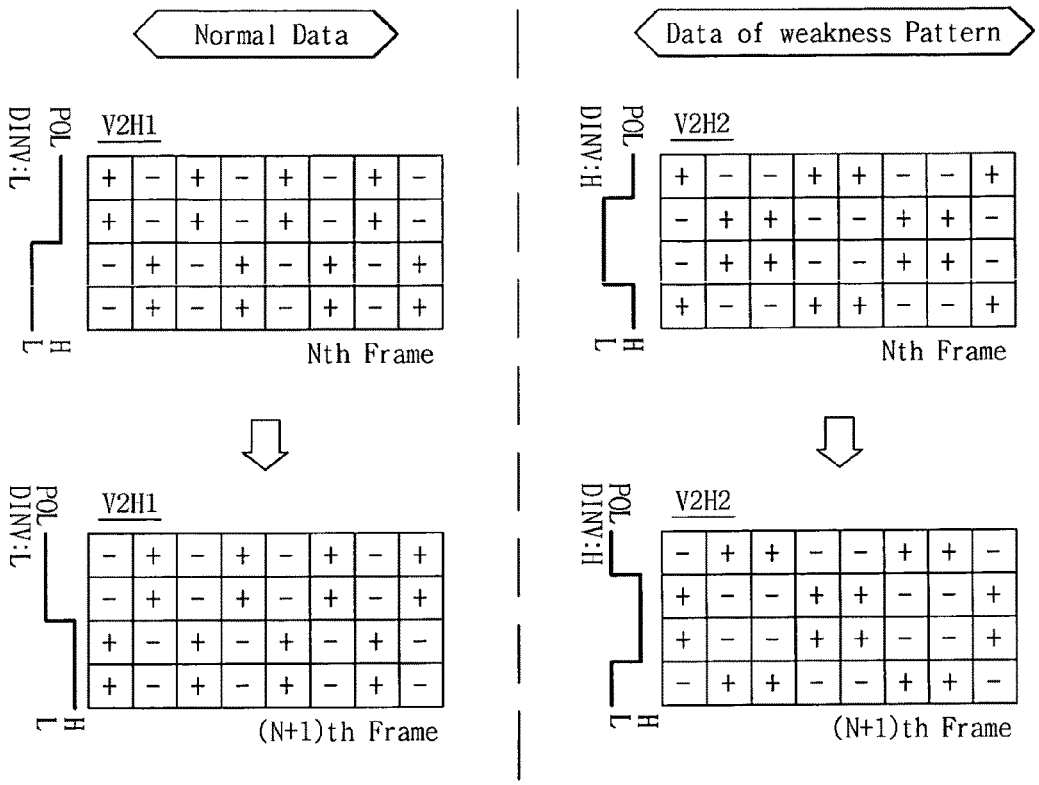
FIG. 20 is a diagram illustrating the changes of the polarity of data voltages supplied to the LCD panel when the data which may have the weak pattern or the DC image sticking is inputted.

If the polarity control signal (POL) of which phase is shifted is reversed with the vertical 2-dot period, that is 2-horizontal period and the dot inversion control signal (DINV) is high logic (H), the horizontal polarity of the odd lines of the data voltage supplied to the data lines (D1 to Dm) will change as "+−−+" for Nth frame period, and as "−++−" for $(N+1)^{th}$ frame period, as shown in the right side figure of the FIG. 20. Therefore, when the dot inversions control signal has the high logic (H), the LCD device is driven in the Horizontal 2-dot and Vertical 2-dot inversion mode (V2H2).

Figure 1:
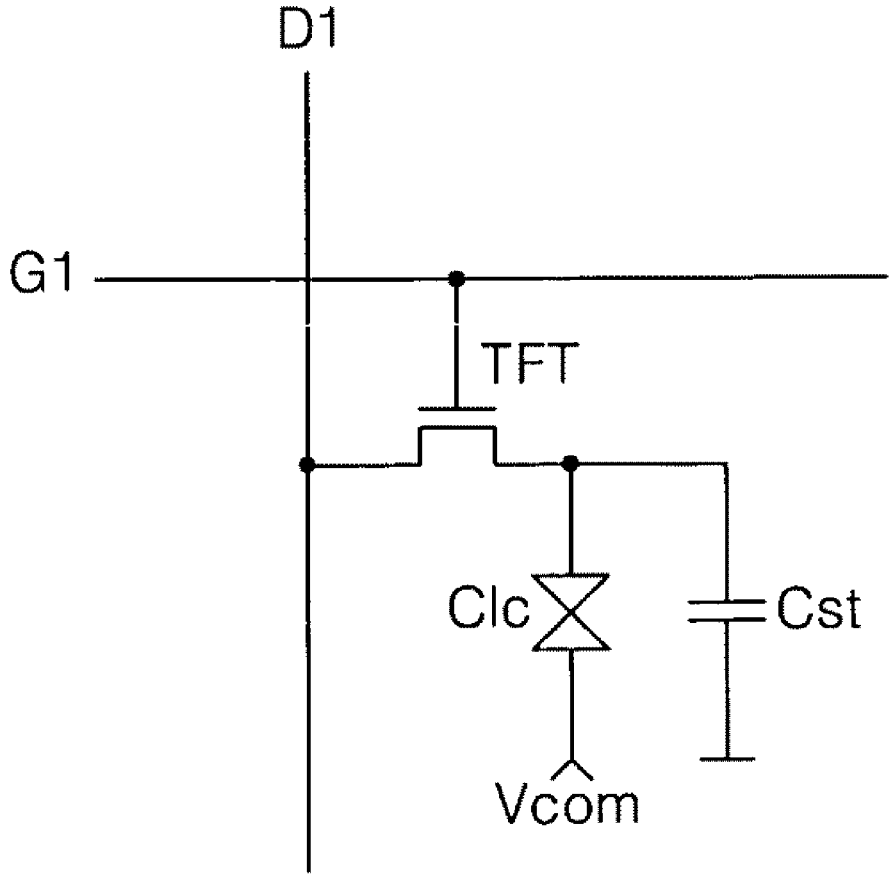
FIG. 1 (Related art)
FIG. 1 is the equivalent circuit diagram illustrating the liquid cell of the liquid crystal display device.
Figure 2:
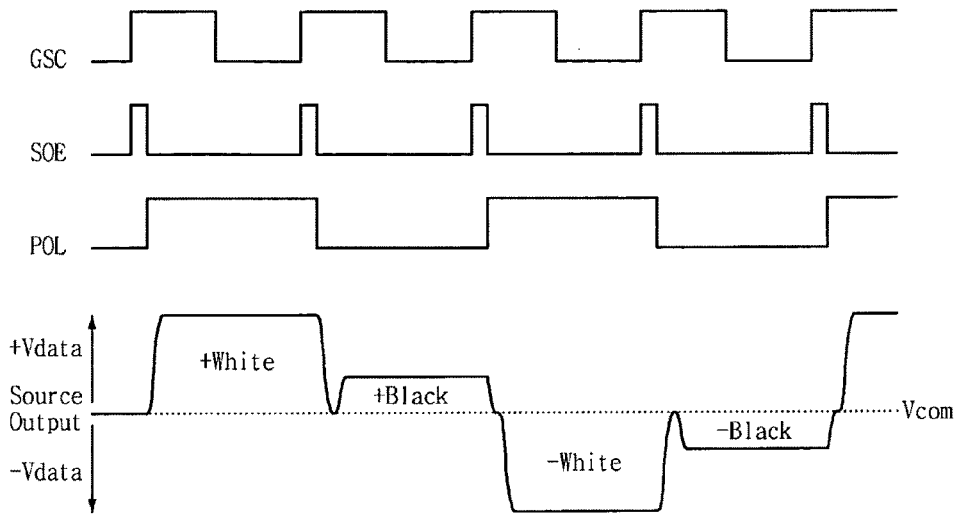
FIG. 2 (Related art)
FIG. 2 is the waveform illustrating the charge share according to the related art.
Figure 8:
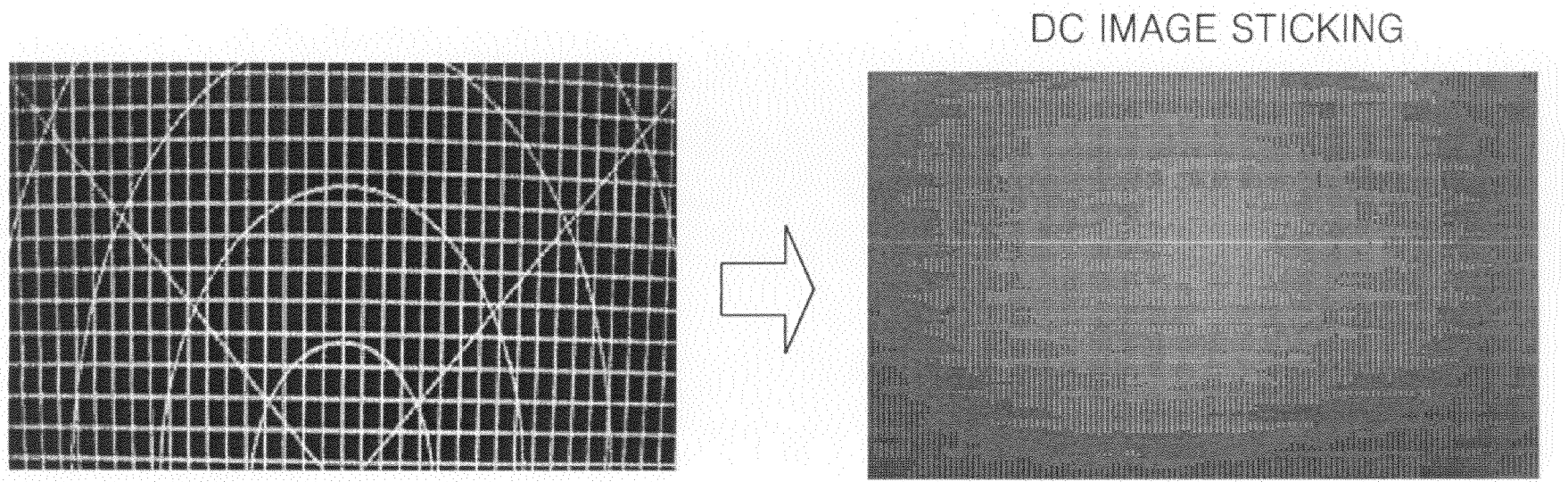
FIG. 8 (Related art)
FIG. 8 is the picture illustrating the experience result of the DC image sticking due to the interlace data.

As shown in FIG. 2, the liquid crystal display device according to the second embodiment of the present disclosure shifts the phase of the polarity control signal (POL) and activates the dot inversion control signal (DINV) just when the weak pattern in which the White gray scale data and the Black gray-scale data are regularly disposed as shown in FIGS. 4 to 6 is inputted or just when the DC image sticking data as shown in FIGS. 7 and 9 is inputted. Therefore, the LCD device according to the second embodiment of the present disclosure is driven in the horizontal 1-dot inversion mode having high quality of the displayed image when the inputted image data is not the weak pattern data. However, when the weak pattern data is inputted, detecting the input of the weak pattern data, the LCD device is driven in the horizontal 2-dot inversion mode to prevent the greenish or flicker problems.

In the interim, the horizontal 2-dot inversion can be replaced with the horizontal N dot inversion (here, N is an integer number larger than 2). Also, the vertical 2-dot inversion can be replaced with the vertical M dot inversion (here, M is an integer number larger than 2).

Figure 21:
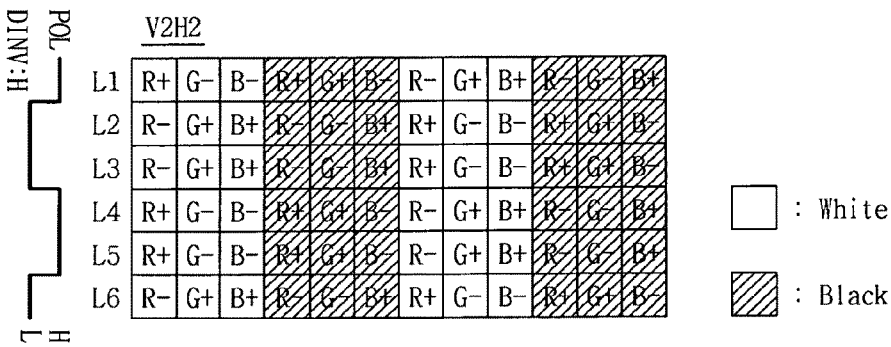
FIG. 21 is a diagram illustrating the improvement effect of the image quality when weak pattern shown in FIG. 4 is represented.
Figure 22:
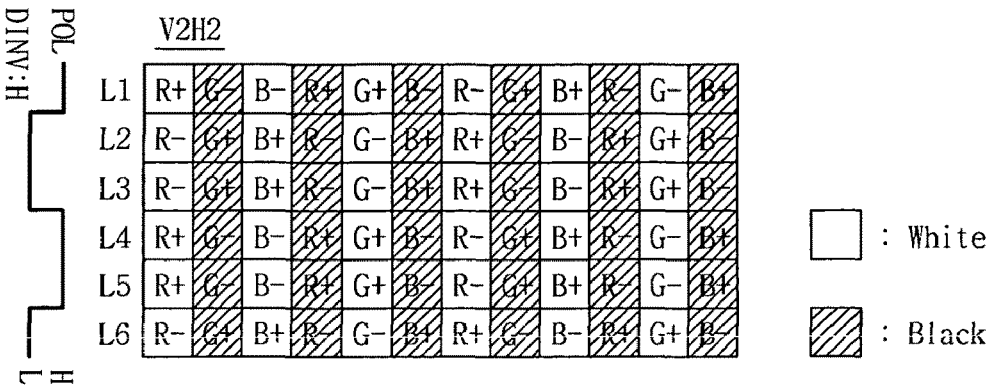
FIG. 22 is a diagram illustrating the improvement effect of the image quality when weak pattern shown in FIG. 5 is represented.

FIGS. 21 and 22 illustrate the effects of the image improvement when the weak pattern data is inputted.

The liquid crystal display device and the driving method thereof can reduce the consumption electric power and heat of the data driving circuit 22 by shifting the phase of the polarity control signal (POL) when the weak pattern data as shown in FIG. 4 or FIG. 5 is inputted. Further, activating the dot inversion control signal (DINV), the horizontal polarity reversing period of the data voltages can be expanded to prevent the greenish problem and to improve the image quality. As shown in FIGS. 21 and 22, in the LCD device according to the present disclosure, the polarity of the green data voltage does not kept in any one value at the weak pattern data so that the greenish phenomenon is not occurred.

Further, when the DC image sticking data is inputted, the LCD device and the driving method thereof shifts the phase of the polarity control signal (POL) and reverses the dot inversion control signal (DINV) periodically for example with 1 frame period as shown in FIG. 24 to prevent the DC image sticking. More detail, the LCD device and the driving method thereof shifts the phase of the polarity control signal (POL) and activates the dot inversion control signal (DINV) to drive the liquid crystal cells by dividing the liquid crystal cells into the first liquid crystal cell group and the second liquid crystal cell group which are charging the data voltages different each other for 2 frame periods. For example, within the 2-frame period, the first liquid crystal cell group is driven by the data voltage frequency of 30 Hz, while the second liquid crystal cell group is driven by the data voltage frequency of 60 Hz. It is obvious that the first liquid crystal cell group is driven by the data voltage frequency of 60 Hz, while the second liquid crystal cell group is driven by the data voltage frequency of 30 Hz, within the 2-frame period.

The driving method of the liquid crystal display device according to the second embodiment of the present disclosure is to prevent the DC image sticking by supplying the data voltages of which polarity is reversed at every 2-frame to the first liquid crystal cell group, and to prevent the flicker phenomenon by supplying the data voltages of which polarity is reversed at every 1-frame period to the first liquid crystal cell group.

Figure 23:
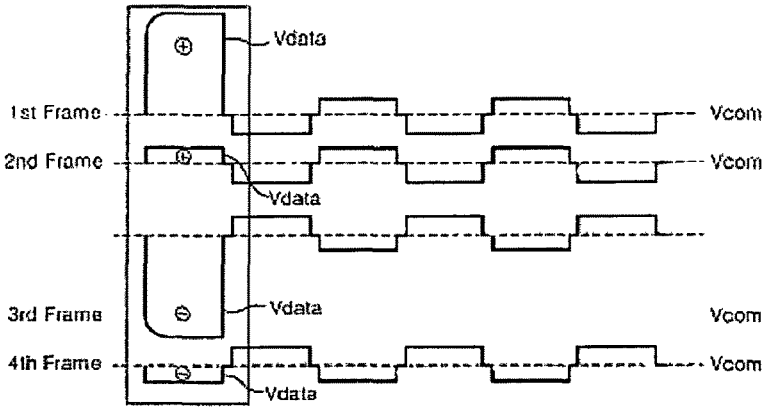
FIG. 23 is a waveform illustrating the effect for preventing the DC image sticking due to the first liquid crystal cell group in the liquid crystal display device according to the second embodiment of the present disclosure.

Referring to FIG. 23, any liquid crystal cell included in the first liquid crystal cell group is supplied with the high data voltage for the odd frame period and with the low data voltage for even frame period, and the polarity of these data voltages is alternated with the 2-frame period frequency. Therefore, the positive data voltage supplied to the first liquid crystal cell group for the first and the second frame periods is compensated with the negative data voltage supplied to the first liquid crystal cell group for the third and the fourth frame periods. As a result, the first liquid crystal cell group does not have stored voltage of any one kind of polarity. The LCD device and the driving method according to the second embodiment of the present disclosure has no DC image sticking problem.

Even if the first liquid crystal cell group can prevents the DC image sticking problem, there may be flicker problem because the same polarity data voltages are supplied to the first liquid crystal cell group with 2 frame period frequency. To the second liquid crystal cell group, the data voltage of which polarity is reversed in 1-frame period frequency so that the flicker is not detected by bare eyes. Therefore, it is possible to reduce the flicker due to the first liquid crystal cell group. As the human eyes does not so sensitive to the change of image light, when a person sees the LCD comprising the first and the second liquid crystal cells having different driving frequency, the eyes feel the driving frequency of overall LCD panel with the higher frequency, for example, in this case, the driving frequency of the second liquid crystal cell group.

FIG. 24 illustrates the polarity change of the data voltage supplied to the liquid crystal display panel when the DC image sticking data is inputted.

Referring to FIG. 24, when the DC image sticking data is inputted, the timing controller 21 shifts the phase of the polarity control signal (POL) and reverses the dot inversion control signal (DINV) in 1-frame period frequency.

For the $(4i+1)^{th}$ frame period, the first liquid crystal cell group includes the liquid crystal cells disposed at the $(4i+3)^{th}$ and the $(4i+4)^{th}$ vertical lines (C3, C4, C7 and C8) in the $(4i+1)^{th}$ and the $(4i+3)^{th}$ horizontal lines (L1, L3, L5 and L7), and the liquid crystal cells disposed at the $(4i+1)^{th}$ and the $(4i+2)^{th}$ vertical lines (C1, C2, C5 and C6) in the $(4i+2)^{th}$ and the $(4i+4)^{th}$ horizontal lines (L2, L4 and L6), here i is one natural number. The second liquid crystal cell group is disposed between the first liquid crystal cell group in vertical and horizontal directions. The second liquid crystal cell group includes the liquid crystal cells disposed at the $(4i+1)^{th}$ and the $(4i+2)^{th}$ vertical lines (C1, C2, C5 and C6) in the $(4i+1)^{th}$ and the $(4i+3)^{th}$ horizontal lines (L1, L3, L5 and L7), and the liquid crystal cells disposed at the $(4i+3)^{th}$ and the $(4i+4)^{th}$ vertical lines (C3, C4, C7 and C8) in the $(4i+2)^{th}$ and the $(4i4)^{th}$ horizontal lines (L2, L4 and L6). Each of the first and the second liquid crystal cell groups is disposed in the unit of 2×1 liquid crystal cells neighboring in horizontal direction. The polarities of the data voltages charged into the liquid crystal cells neighboring in the 2×1 liquid crystal cells are opposite polarities each other. The liquid crystal cells in the first liquid crystal cell group have the data voltages having polarity opposite to those of the liquid crystal cells in the second liquid crystal cell group neighboring with the first liquid crystal cell group. To do this, the polarity control signal (POL) generated for the $(4i+1)^{th}$ frame period is reversed with the 2-horizontal period frequency, and has the phase difference of 1-horizontal period to the first polarity control signal (POL 1). Within the black period prior to the $(4i+1)^{th}$ frame period, the polarity of the polarity control signal (POL) is reversed with the 2-horizontal period unit, and has the phase difference of the 1-horizontal period to the previous frame period. Further, within the black period prior to the $(4i+1)^{th}$ frame period, the dot inversion control signal (DINV) is activated to the high logic.

For the $(4i+2)^{th}$ frame period, the first liquid crystal cell group includes the liquid crystal cells disposed at the $(4i+1)^{th}$ and the $(4i+2)^{th}$ vertical lines (C1, C2, C5 and C6) in the $(4i+1)^{th}$ and the $(4i+3)^{th}$ horizontal lines (L1, L3, L5 and L7), and the liquid crystal cells disposed at the $(4i+3)^{th}$ and the $(4i+4)^{th}$ vertical lines (C3, C4, C7 and C8) in the $(4i+2)^{th}$ and the $(4i+4)^{th}$ horizontal lines (L2, L4 and L6). The second liquid crystal cell group is disposed between the first liquid crystal cell group in vertical and horizontal directions. The second liquid crystal cell group includes the liquid crystal cells disposed at the $(4i+3)^{th}$ and the $(4i+4)^{th}$ vertical lines (C3, C4, C7 and C8) in the $(4i+1)^{th}$ and the $(4i+3)^{th}$ horizontal lines (L1, L3, L5 and L7), and the liquid crystal cells disposed at the $(4i+1)^{th}$ and the $(4i+2)^{th}$ vertical lines (C1, C2, C5 and C6) in the $(4i+2)^{th}$ and the $(4i+4)^{th}$ horizontal lines (L2, L4 and L6). Each of the first and the second liquid crystal cell groups is disposed in the unit of 2×1 liquid crystal cells neighboring in horizontal direction. The polarities of the data voltages charged into the liquid crystal cells neighboring in the 2×1 liquid crystal cells are opposite polarities each other. The liquid crystal cells in the first liquid crystal cell group have the data voltages having polarity opposite to those of the liquid crystal cells in the second liquid crystal cell group neighboring with the first liquid crystal cell group. The polarity of the data voltages supplied to each of the first and the second liquid crystal cell groups for the $(4i+2)^{th}$ frame period has the reversed polarity of the data voltages supplied each of the first and the second liquid crystal cell groups for the $(4i+1)^{th}$ frame period. Within the black period prior to the $(4i+2)^{th}$ frame period, the polarity of the polarity control signal (POL) is reversed with the 2-horizontal period unit, and has the phase difference of the 1-horizontal period to the $(4i+1)^{th}$ frame period. Further, within the black period prior to the $(4i+2)^{th}$ frame period, the dot inversion control signal (DINV) is reversed to the low logic.

For the $(4i+3)^{th}$ frame period, the first liquid crystal cell group includes the liquid crystal cells disposed at the $(4i+3)^{th}$ and the $(4i+4)^{th}$ vertical lines (C3, C4, C7 and C8) in the $(4i+1)^{th}$ and the $(4i+3)^{th}$ horizontal lines (L1, L3, L5 and L7), and the liquid crystal cells disposed at the $(4i+1)^{th}$ and the $(4i+2)^{th}$ vertical lines (C1, C2, C5 and C6) in the $(4i+2)^{th}$ and the $(4i+4)^{th}$ horizontal lines (L2, L4 and L6). The second liquid crystal cell group is disposed between the first liquid crystal cell group in vertical and horizontal directions. The second liquid crystal cell group includes the liquid crystal cells disposed at the $(4i+1)^{th}$ and the $(4i+2)^{th}$ vertical lines (C1, C2, C5 and C6) in the $(4i+1)^{th}$ and the $(4i+3)^{th}$ horizontal lines (L1, L3, L5 and L7), and the liquid crystal cells disposed at the $(4i+3)^{th}$ and the $(4i+4)^{th}$ vertical lines (C3, C4, C7 and C8) in the $(4i+2)^{th}$ and the $(4i+4)^{th}$ horizontal lines (L2, L4 and L6). Each of the first and the second liquid crystal cell groups is disposed in the unit of 2×1 liquid crystal cells neighboring in horizontal direction. The polarities of the data voltages charged into the liquid crystal cells neighboring in the 2×1 liquid crystal cells are opposite polarities each other. The liquid crystal cells in the first liquid crystal cell group have the data voltages having polarity opposite to those of the liquid crystal cells in the second liquid crystal cell group neighboring with the first liquid crystal cell group. The polarity of the data voltages supplied to each of the first and the second liquid crystal cell groups for the $(4i+3)^{th}$ frame period has the reversed polarity of the data voltages supplied each of the first and the second liquid crystal cell groups for the $(4i+2)^{th}$ frame period. Within the black period prior to the $(4i+3)^{th}$ frame period, the polarity of the polarity control signal (POL) is reversed with the 2-horizontal period unit, and has the phase difference of the 1-horizontal period to the $(4i+2)^{th}$ frame period. Further, within the black period prior to the $(4i+3)^{th}$ frame period, the dot inversion control signal (DINV) is reversed to the high logic.

For the $(4i+4)^{th}$ frame period, the first liquid crystal cell group includes the liquid crystal cells disposed at the $(4i+1)^{th}$ and the $(4i+2)^{th}$ vertical lines (C1, C2, C5 and C6) in the $(4i+1)^{th}$ and the $(4i+3)^{th}$ horizontal lines (L1, L3, L5 and L7), and the liquid crystal cells disposed at the $(4i+3)^{th}$ and the $(4i+4)^{th}$ vertical lines (C3, C4, C7 and C8) in the $(4i+2)^{th}$ and the $(4i+4)^{th}$ horizontal lines (L2, L4 and L6). The second liquid crystal cell group is disposed between the first liquid crystal cell group in vertical and horizontal directions. The second liquid crystal cell group includes the liquid crystal cells disposed at the $(4i+3)^{th}$ and the $(4i+4)^{th}$ vertical lines (C3, C4, C7 and C8) in the $(4i+1)^{th}$ and the $(4i+3)^{th}$ horizontal lines (L1, L3, L5 and L7), and the liquid crystal cells disposed at the $(4i+1)^{th}$ and the $(4i+2)^{th}$ vertical lines (C1, C2, C5 and C6) in the $(4i+2)^{th}$ and the $(4i+4)^{th}$ horizontal lines (L2, L4 and L6). Each of the first and the second liquid crystal cell groups is disposed in the unit of 2×1 liquid crystal cells neighboring in horizontal direction. The polarities of the data voltages charged into the liquid crystal cells neighboring in the 2×1 liquid crystal cells are opposite polarities each other. The liquid crystal cells in the first liquid crystal cell group have the data voltages having polarity opposite to those of the liquid crystal cells in the second liquid crystal cell group neighboring with the first liquid crystal cell group. Within the black period prior to the $(4i+4)^{th}$ frame period, the polarity of the polarity control signal (POL) is reversed with the 2-horizontal period unit, and has the phase difference of the 1-horizontal period to the $(4i+3)^{th}$ frame period. Further, within the black period prior to the $(4i+4)^{th}$ frame period, the dot inversion control signal (DINV) is reversed to the low logic.

As set forth above, the liquid crystal display device and the driving method according to the embodiments of the present disclosure analyze the data and shift the phase of the polarity control signal so that the consumption electric power and the heat of the data driving circuit is reduced when the data voltage is changed from the Black gray-scale to the White gray-scale. Further, it can prevent the greenish and flicker problems and enhance the displayed image quality. In addition, the liquid crystal display device and the driving method according to the embodiments of the present disclosure shift the phase of the polarity control signal periodically, and reverse the horizontal dot inversion signal when the DC image sticking data is inputted so that the DC image sticking is prevented and the displayed image quality can be enhanced.

What is claimed is:

1. A liquid crystal display device comprising:

a liquid crystal display panel including a plurality of data lines crossing a plurality of gate lines and liquid crystal cells arranged in a matrix;

a timing controller generating a polarity control signal, deciding if a predetermined weak pattern data is input, and shifting a phase of the polarity control signal in a next frame period following a frame showing the weak pattern data when the weak pattern data is input;

a data driving circuit reversing the polarity of the data voltage in response to the polarity control signal and supplying to the data lines; and a gate driving circuit supplying a gate pulse to the gate lines sequentially, wherein the timing controller comprises:

a data analyzer deciding each gray-scale level of the input digital video data based on most significant bits of the input digital video data, deciding a representative gray-scale level of each line based on each gray-scale level to detect the weak pattern data, and generating a selection signal within a blank period between the previous frame period and the next frame period when the weak pattern data is inputted; and a phase controller generating a first polarity control signal and a second polarity control signal having different phase from the first polarity control signal, and selecting any one of the first and the second polarity control signals in response to the selection signal, wherein the weak pattern data includes a data pattern in which a white gray scale data and a black gray scale data are alternately disposed in horizontal direction of the liquid crystal display panel.

2. The device according to the claim 1, wherein a logic reversing period of the second polarity control signal is substantially same with a logic reversing period of the first polarity control signal.

3. A liquid crystal display device comprising:

a liquid crystal display panel including a plurality of data lines crossing a plurality of gate lines and liquid crystal cells arranged in a matrix;

a timing controller generating a polarity control signal, deciding if a predetermined weak pattern data and a DC image sticking data are input, and shifting a phase of the polarity control signal in a next frame period following a frame showing the weak pattern data when the weak pattern data and the DC image sticking data are input;

a data driving circuit reversing the polarity of the data voltage in response to the polarity control signal, expanding a horizontal polarity inversion period of the data voltages in response to a dot inversion control signal from the timing controller, and supplying to the data lines; and a gate driving circuit supplying a gate pulse to the gate lines sequentially, wherein the weak pattern data includes a data pattern in which a white gray scale data and a black gray scale data are alternately disposed in horizontal direction of the liquid crystal display panel.

4. The device according to the claim 2, wherein the timing controller shifts a phase of the polarity control signal with one frame period, and reverses the dot inversion control signal in one frame period frequency when the DC image sticking data is input.

5. A method for driving a liquid crystal display device including a liquid crystal panel that has a plurality of data lines crossing a plurality of gate lines and liquid crystal cells arranged in a matrix comprising:

generating a polarity control signal;

deciding if a predetermined weak pattern data is input;

deciding each gray-scale level of an input digital video data based on most significant bits of the input digital video data;

deciding a representative gray-scale level of each line based on each gray-scale level to detect an weak pattern data, generating a selection signal within a blank period between a previous frame period and a next frame period when the weak pattern data is inputted;

generating a first polarity control signal and a second polarity control signal having different phase from the first polarity control signal; and selecting any one of the first and the second polarity control signals in response to the selection signal to shift, the polarity control signal within the next frame period showing the weak pattern data when the weak pattern data is input;

reversing the polarity of data voltages by controlling a data driving circuit with the polarity control signal, and supplying the reversed data voltages to the data lines; and supplying a gate pulse to the gate line sequentially by controlling a gate driving circuit, wherein the weak pattern data includes a data pattern in which a white gray scale data and a black gray scale data are alternately disposed in horizontal direction of the liquid crystal display panel.

6. The method according to the claim 5, wherein a logic reversing period of the second polarity control signal is substantially same with a logic reversing period of the first polarity control signal.

* * * * *